US009802732B2

(12) United States Patent
Clark et al.

(10) Patent No.: US 9,802,732 B2
(45) Date of Patent: Oct. 31, 2017

(54) LIGHTWEIGHT AND RIGID PALLET

(71) Applicant: GREEN OX PALLET TECHNOLOGY, LLC, Centennial, CO (US)

(72) Inventors: Colin D. Clark, Larkspur, CO (US); Gregory D. Van de Mark, Littleton, CO (US); Stanley D. Hisel, Littleton, CO (US)

(73) Assignee: GREEN OX PALLET TECHNOLOGY, LLC, Centennial, CO (US)

( * ) Notice: Subject to any disclaimer, the term of this patent is extended or adjusted under 35 U.S.C. 154(b) by 0 days.

(21) Appl. No.: 14/847,680

(22) Filed: Sep. 8, 2015

(65) Prior Publication Data

US 2016/0068302 A1 Mar. 10, 2016

Related U.S. Application Data

(60) Provisional application No. 62/047,538, filed on Sep. 8, 2014.

(51) Int. Cl.
*B65D 19/38* (2006.01)
*B65D 19/00* (2006.01)

(52) U.S. Cl.
CPC ..... *B65D 19/0059* (2013.01); *B65D 19/0085* (2013.01); *B65D 2519/008* (2013.01);
(Continued)

(58) Field of Classification Search
CPC ..... B65D 19/0059; B65D 19/0085; B65D 2519/00024; B65D 2519/00059;
(Continued)

(56) References Cited

U.S. PATENT DOCUMENTS 2,866,629 A 12/1958 Nelson
2,868,487 A * 1/1959 Robinson ..... B65D 19/0012 108/57.1

(Continued)

FOREIGN PATENT DOCUMENTS

NL 8800486 A 6/1989
WO 9823490 A1 6/1998

(Continued)

OTHER PUBLICATIONS

International Bureau, "Search Report and Written Opinion dated Oct. 30, 2015", PCT Application No. PCT/US2015/048906, Published WO/2016/040300, Oct. 30, 2015, 11 Pages.

*Primary Examiner* — Jose V Chen
(74) *Attorney, Agent, or Firm* — Dorsey & Whitney LLP

(57) ABSTRACT

The present disclosure includes a shipping pallet including an upper deck, a lower deck, and a plurality of pillars. The upper deck includes an upper exterior surface and an upper interior surface. The lower deck defines a lower exterior surface and a lower interior surface. The pillars are connected between the upper deck and the lower and the combination of the pillars, the upper deck, and the lower deck defines a space frame structure. Various components, such as the pillars, upper deck, and lower deck may be webbed-formed structures for enhanced rigidity.

13 Claims, 26 Drawing Sheets

(52) U.S. Cl.
CPC ..... *B65D 2519/00024* (2013.01); *B65D 2519/00059* (2013.01); *B65D 2519/00094* (2013.01); *B65D 2519/00273* (2013.01); *B65D 2519/00293* (2013.01); *B65D 2519/00308* (2013.01); *B65D 2519/00318* (2013.01); *B65D 2519/00333* (2013.01); *B65D 2519/00373* (2013.01); *B65D 2519/00378* (2013.01); *B65D 2519/00562* (2013.01); *B65D 2519/00572* (2013.01); *B65D 2519/00796* (2013.01); *B65D 2519/00985* (2013.01)

(58) Field of Classification Search
CPC ..... B65D 2519/00094; B65D 2519/00273; B65D 2519/00293; B65D 2519/00308; B65D 2519/00318; B65D 2519/00333; B65D 2519/00373; B65D 2519/00378; B65D 2519/00562; B65D 2519/00572; B65D 2519/00796; B65D 2519/008; B65D 2519/00985
USPC .... 108/56.3, 51.11, 51.3, 57.22, 57.1, 57.21, 108/57.23, 57.31, 57.33, 57.26, 57.25, 108/57.19, 57.2
See application file for complete search history.

(56) References Cited

U.S. PATENT DOCUMENTS

| | | | | | |
|---|---|---|---|---|---|
| 3,667,403 | A * | 6/1972 | Angelbeck, Jr. | B65D 19/0012 | 108/57.26 |
| 3,762,344 | A | 10/1973 | Chez | | |
| 3,868,915 | A * | 3/1975 | Hafner | B65D 19/0012 | 108/53.1 |
| 4,399,972 | A * | 8/1983 | McCulloch | A63H 33/04 | 108/51.3 |
| 4,735,154 | A * | 4/1988 | Hemery | B65D 19/0012 | 108/56.1 |
| 4,843,976 | A * | 7/1989 | Pigott | B65D 19/0012 | 108/56.1 |
| 5,056,666 | A * | 10/1991 | Janssens | B65D 19/12 | 108/56.3 |
| 5,092,252 | A | 3/1992 | Gillhart | | |
| 5,433,156 | A | 7/1995 | Hutchison | | |
| 5,460,103 | A * | 10/1995 | Dunn | B65D 19/0018 | 108/57.18 |
| 5,483,899 | A * | 1/1996 | Christie | B65D 19/0073 | 108/56.3 |
| 5,676,063 | A | 10/1997 | Wallace | | |
| 5,836,255 | A | 11/1998 | Uitz | | |
| 5,887,529 | A * | 3/1999 | John | B65D 19/0018 | 108/56.1 |
| 6,029,582 | A * | 2/2000 | Ogilvie, Jr. | B65D 19/0012 | 108/165 |
| 6,453,827 | B1 | 9/2002 | Perazzo | | |
| 6,612,247 | B1 | 9/2003 | Pistner et al. | | |
| 6,701,852 | B2 | 3/2004 | Sedge | | |
| 6,802,267 | B1 | 10/2004 | Janus | | |
| 6,807,911 | B2 | 10/2004 | Carson et al. | | |
| 7,107,912 | B2 | 9/2006 | Schütz | | |
| 7,360,493 | B2 | 4/2008 | Hummel et al. | | |
| 7,640,867 | B2 | 1/2010 | Ogburn et al. | | |
| 7,661,373 | B2 * | 2/2010 | Apps | B65D 19/0012 | 108/56.3 |
| 7,739,965 | B2 | 6/2010 | Heinrichs et al. | | |
| 7,779,764 | B2 * | 8/2010 | Naidu | B65D 19/0095 | 108/56.1 |
| 7,866,501 | B2 | 1/2011 | Schütz | | |
| 8,056,488 | B2 | 11/2011 | Apps et al. | | |
| 8,196,527 | B2 | 6/2012 | Linares | | |
| 8,522,694 | B2 | 9/2013 | Linares | | |
| 8,667,905 | B2 | 3/2014 | Anderson et al. | | |
| 8,863,674 | B2 * | 10/2014 | Smolenaers | B65D 19/0016 | 108/51.11 |
| 9,139,334 | B2 * | 9/2015 | Wahl | B65D 19/0016 | |
| 2003/0070593 | A1 * | 4/2003 | Halavais | B65D 19/0051 | 108/51.11 |
| 2006/0185565 | A1 * | 8/2006 | Brochu | B65D 19/0059 | 108/57.25 |
| 2006/0236900 | A1 * | 10/2006 | Brochu | B65D 19/0036 | 108/51.11 |
| 2007/0234933 | A1 * | 10/2007 | Donnell, Jr. | B65D 19/0016 | 108/56.3 |
| 2008/0143514 | A1 * | 6/2008 | Valentinsson | B65D 19/0014 | 340/539.1 |
| 2014/0190372 | A1 | 7/2014 | Smolenaers | | |
| 2014/0261103 | A1 * | 9/2014 | Kelly | B65D 19/0006 | 108/57.28 |

FOREIGN PATENT DOCUMENTS

| | | |
|---|---|---|
| WO | 2004022459 A2 | 3/2004 |
| WO | 2007048169 A1 | 5/2007 |
| WO | 2009061275 A1 | 5/2009 |

* cited by examiner

LIGHTWEIGHT AND RIGID PALLET

CROSS REFERENCE TO RELATED APPLICATIONS

This application claims priority to U.S. provisional application No. 62/047,538 entitled "Lightweight and Rigid Pallet" filed Sep. 8, 2014, the disclosure of which is hereby incorporated by reference in its entirety.

FIELD

The present disclosure relates generally to pallets for shipping goods.

BACKGROUND

Pallets are typically used for moving and storing materials. Typically wooden pallets having flat upper and lower surfaces with suitable wooden spacing members between the two surfaces have been used. However, these wooden pallets are heavy, cumbersome, and susceptible to breakage and bacterial growth. They may also suffer weather-related damage, which can ultimately cause failure of the pallet. For example, in freezing weather conditions, wooden pallets may freeze to the ground or other surface. Removal of the frozen pallet may damage or destroy the wooden pallet, requiring repair before the pallet may be used to ship goods.

Accordingly, it is an object of the present disclosure to provide an improved pallet for shipping, moving, storing, and otherwise transporting goods and materials that overcomes one or more of the disadvantages associated with existing pallets.

SUMMARY

One embodiment of the present disclosure may take the form of a shipping pallet. The shipping pallet may include one or more decks and a plurality of pillars removably connected to the one or more decks. Each pillar may include at least one assembly feature configured to receive a fastener to removably connect the plurality of pillars to the one or more decks. In some embodiments, the at least one assembly feature is a depression formed in an exterior surface of the pillar. In other embodiments, the at least one assembly feature is a dimple formed in the pillar and may optionally include a preformed fastening aperture defined through the pillar, where the fastening aperture is configured to receive a fastener. In some embodiments, the decks may include matching depressions or dimples that are configured to receive the depressions of the pillars. The depressions in the decks may also include apertures that align with the apertures within the pillars to allow fasteners to extend through both the pillars and the decks.

The shipping pallet may be reconfigurable and serviceable. For example, the pallet may be disassembled and shipped in a first configuration requiring a first volume of space and then the pallet may be assembled into a second configuration requiring a second volume of space, where the first volume is smaller than the second volume. This allows the pallet to be shipped to a desired location with a reduced volume of space. Additionally, the pallet may be configured to be assembled at substantially any location. Also, the pallet may be shipped in an assembled configuration and disassembled after initial shipping for storage, or the like.

Embodiments of the present disclosure may include a shipping pallet. The shipping pallet may include an upper deck defining an upper exterior surface and an upper interior surface, a lower deck defining a lower exterior surface and a lower interior surface, and a plurality of pillars connecting the upper deck to the lower deck. In some embodiments, the plurality of pillars may be spatially separated from one another. In some embodiments, the combination of the pillars, the upper deck, and the lower deck may define a space frame structure.

Embodiments of the present disclosure may include a shipping pallet. The shipping pallet may include a frame including a first deck, a second deck, and a plurality of pillars removably connected to the plurality of decks. At least one deck panel may be connected to the first deck. In some embodiments, each of the first deck, the second deck, and at least some of the plurality of pillars include webbed structures.

Embodiments of the present disclosure may include a pallet. The pallet may include an upper deck having a plurality of upper deck apertures spatially separated from one another by a first spacing distance, a lower deck having a plurality of lower deck apertures spatially separated from one another by a second spacing distance, a plurality of deck posts connected to the upper deck and the lower deck and spatially separated from one another by a third spacing distance, and a frame web defined by the connection of the upper deck, the lower deck, and the plurality of deck posts.

SPECIFICATION

Overview

Figure 1A:
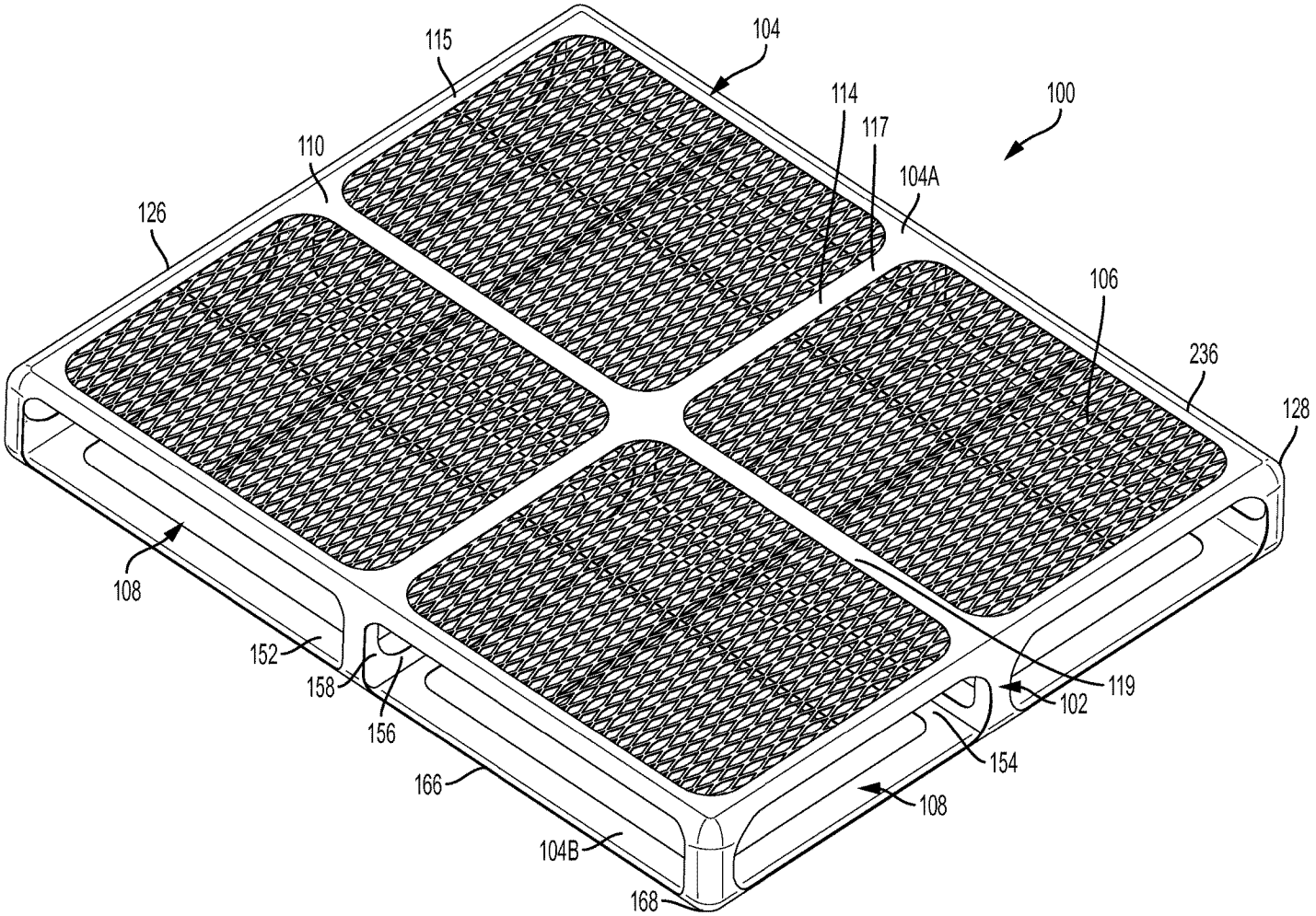
FIG. 1A is a top isometric view of a pallet.
Figure 1B:
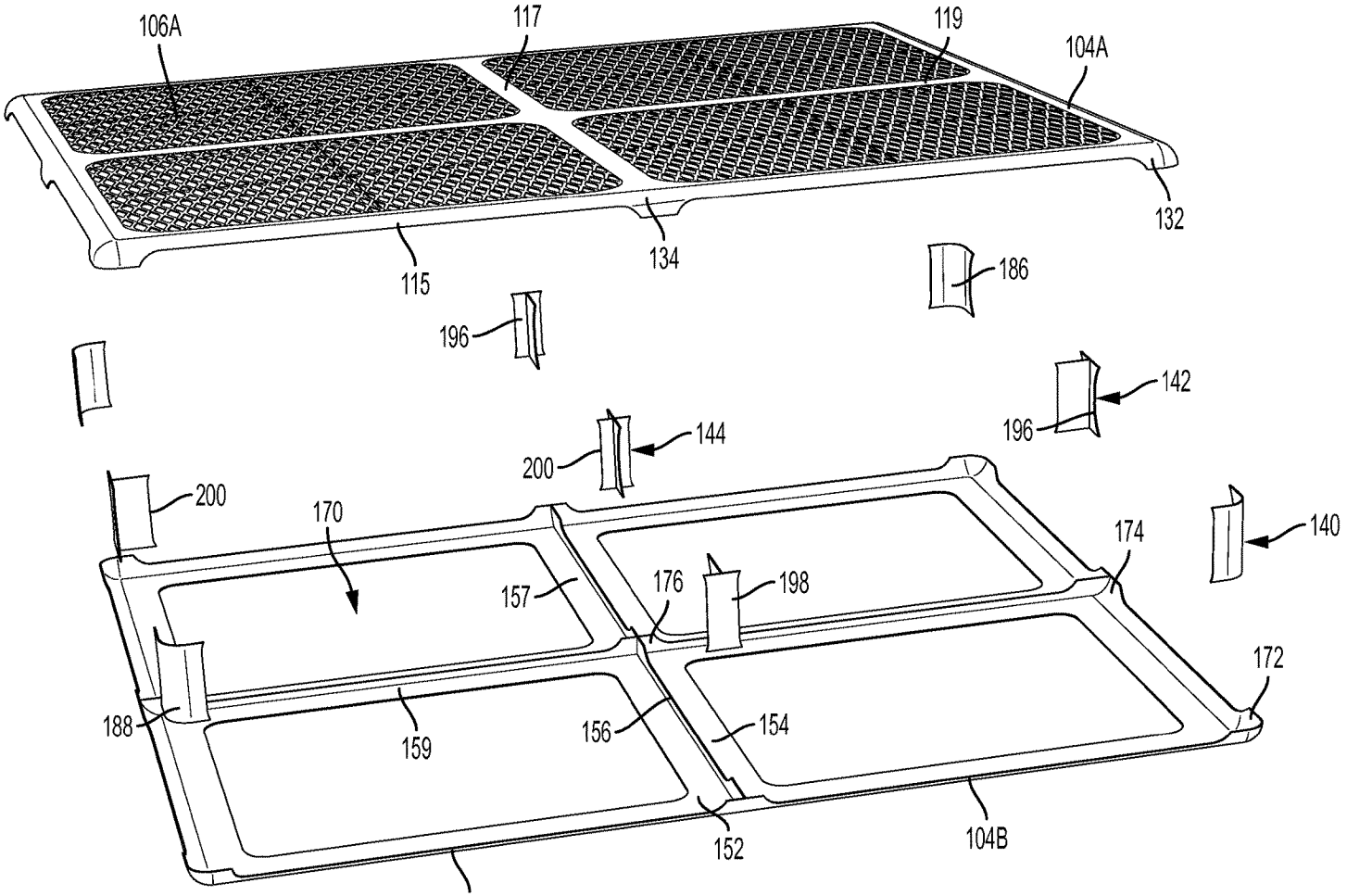
FIG. 1B is an exploded view of the pallet of FIG. 1A.
Figure 1C:
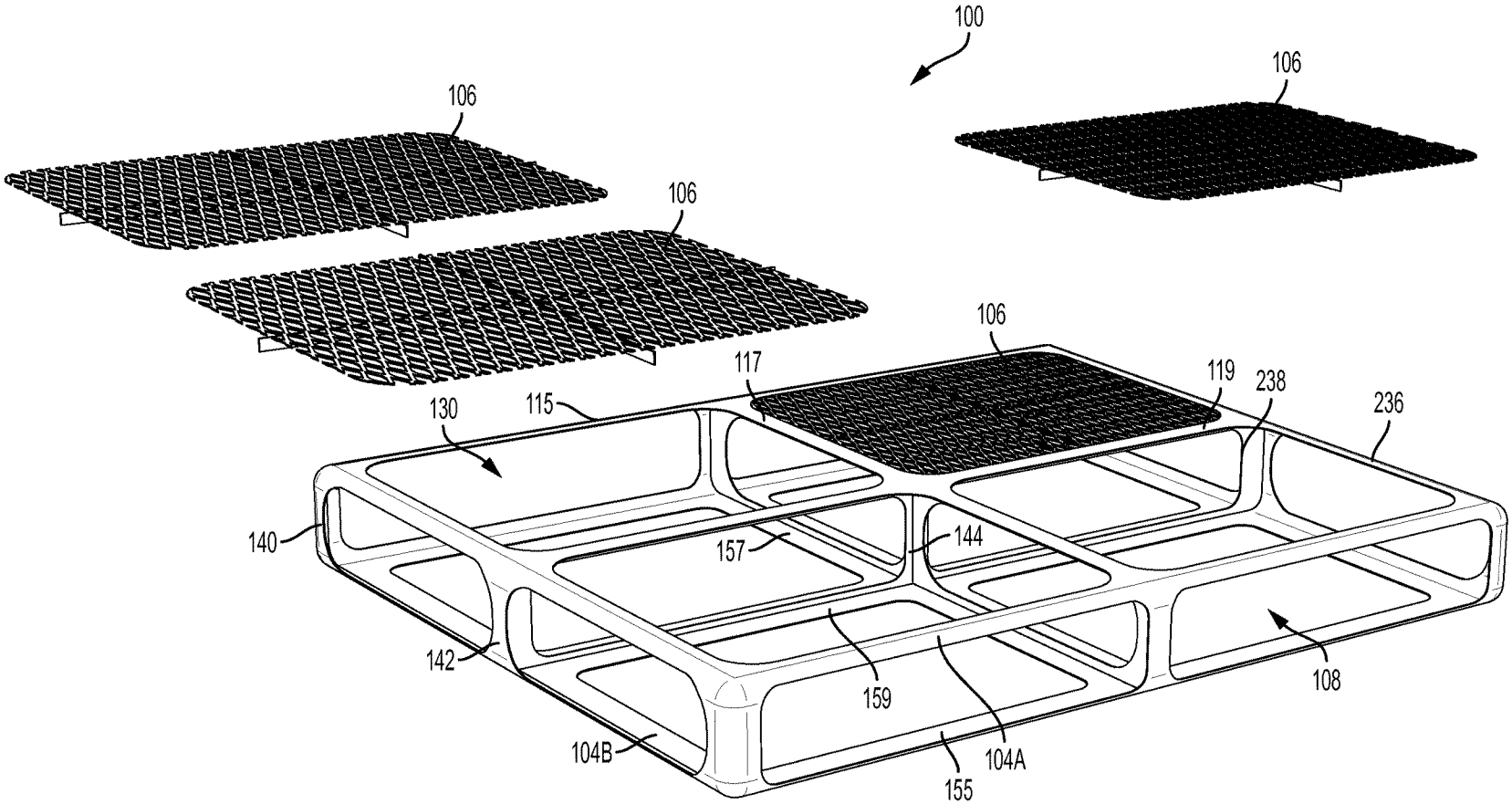
FIG. 1C is a partially exploded view of the pallet of FIG. 1A.
Figure 2:
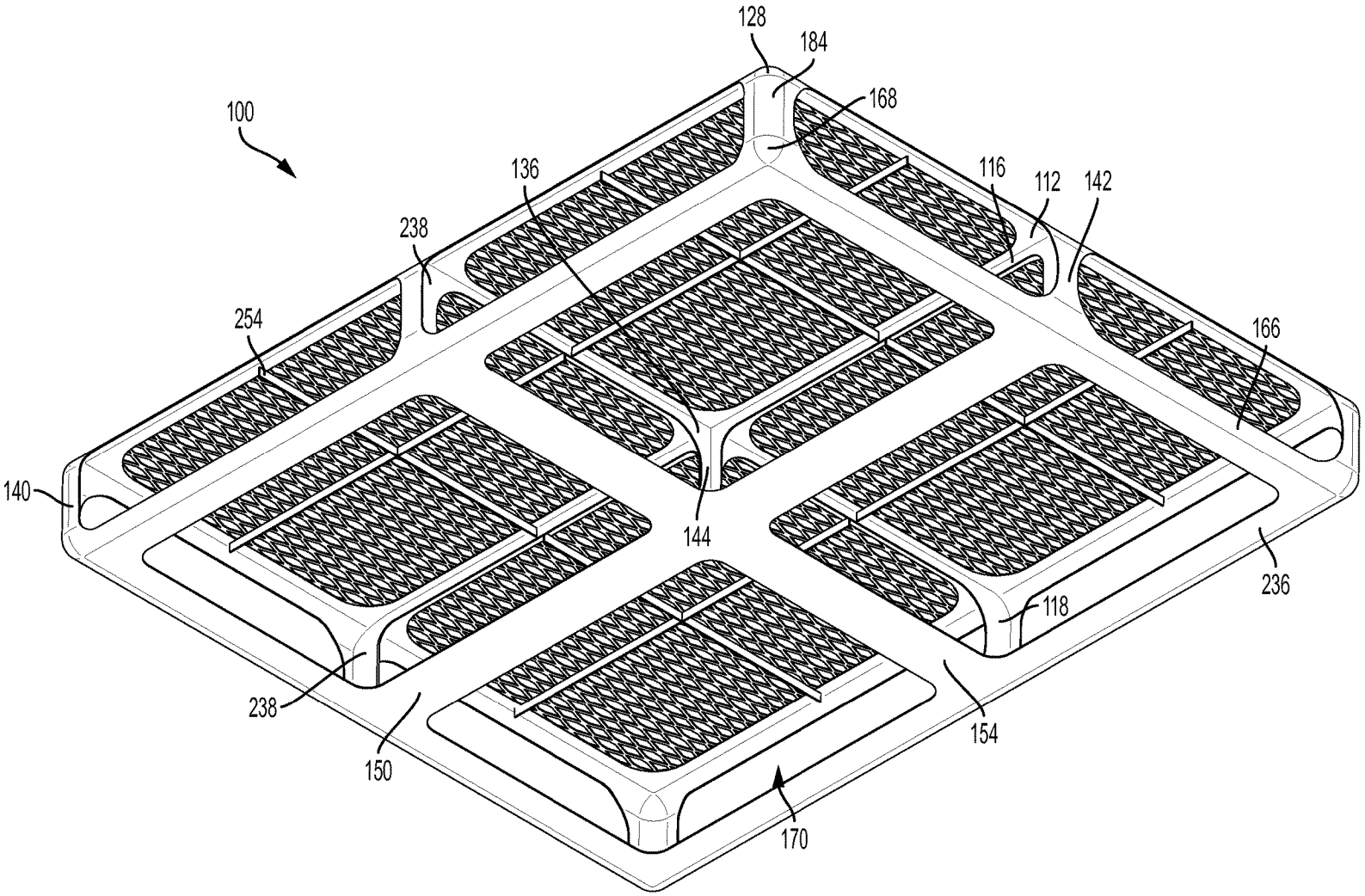
FIG. 2 is a bottom isometric view of the pallet of FIG. 1A.
Figure 3:
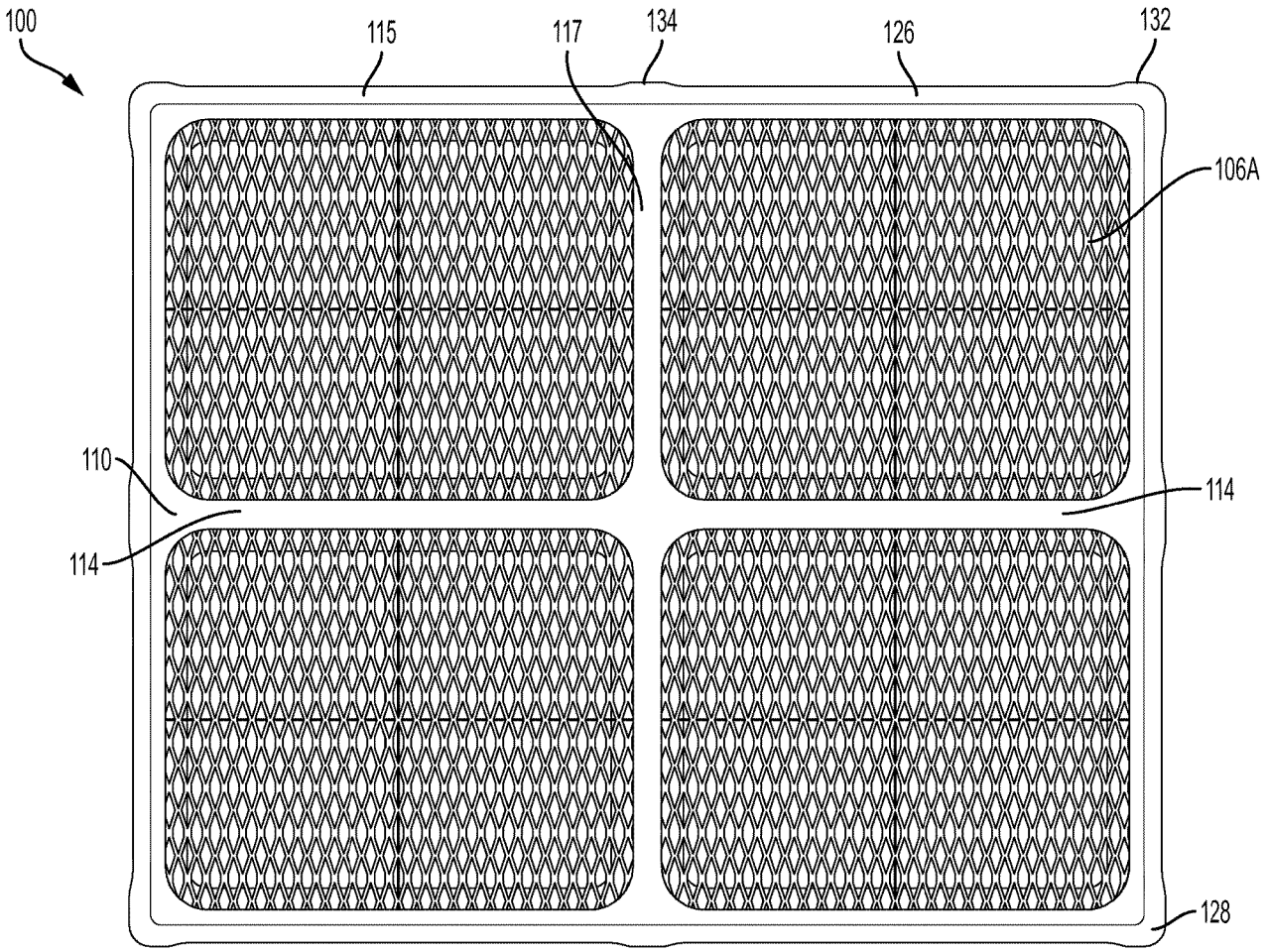
FIG. 3 is a top plan view of the pallet of FIG. 1A.

The present disclosure relates generally to a pallet having a lightweight and rigid structure that can support heavy loads (e.g., 3000 lb loads). In one embodiment, the pallet may include a frame having a space frame, orthogrid, or isogrid structure that allows the frame to be very lightweight, while maintaining the rigidity and strength required to support loads of varying weights. One or more components of the frame may be identical to each other and the frame may include integral components or separate components. Additionally, a deck may be attached to a top and optionally a bottom of the frame. The deck is configured to support different loads and may be varied based on the desired materials and goods to be shipped. In one embodiment, the deck may include a plurality of grid panels or deck boards that are connected to a top portion of the frame.

The pallet of the present disclosure may be transported from a first location in a first configuration and assembled into a second configuration at a second location. For example, the pallet may include one or more deck panels interconnected together through one or more pillars. The decks and the pillars when disconnected can be arranged in a relatively small volume as the elements can be stacked, nested, or the like, against one another to reduce the space that they require. As one example, in the unassembled configuration the pallets may require three times less volume as compared to the assembled configuration. However, in other instances the reduction in volume may be substantially any amount. This allows for shipping costs associated with delivering the pallets to certain locations to be significantly reduced.

After shipping, or whenever the pallets may be desired to be used, the decks and pillars are connected together to form the pallet. The pallet system as disclosed herein includes assembly features that reduce the time and complexity required to assemble the pallet as compared to conventional pallet designs.

In one example, the assembly features include dimples or depressions formed in either the decks and/or the pillars. The dimples may be used as alignment features to indicate to a user assembling the pallet fastening locations that can be used to secure the decks and the pillars together. In some embodiments, walls forming the dimples may have a reduced thickness as compared to other sections of the decks and/or the pillars, allowing fasteners to be inserted through the dimple walls more easily than other sections of the deck panels. In other embodiments, the walls forming the dimples may have substantially the same thickness as other sections of the decks and/or the pillars.

In some instances fastener apertures may be defined in the dimple walls to further increase the ease at which the fasteners can be inserted through the dimples. Further, the decks and the pillars may include corresponding fastening apertures and/or dimples that further enhance the ease of fastening the decks and the pillars together. Alternatively, the dimples may not include apertures and the fasteners that are used may be self-drilled or the apertures may be otherwise defined during insertion of the fasteners. For example, using a nail or rivet gun, the power provided by the gun drives the rivets or nails through the dimple walls without the need for a predrilled or pre-punched aperture. Depending on the gauge or thickness of the material used for the various components of the pallet, in some embodiments, tabs or other foldable pieces of the material may be added to each of the parts. The securing tabs may be folded over to provide an additional thickness at the area where the fastener is to be inserted. This additional material helps to hold the fastener in position, which reduces the chances that a fastener may pull out or otherwise become disconnected without requiring a washer or other two-piece fastening assembly.

In some embodiments, each pallet may include a frame defining a top deck and a bottom deck and the two decks may be separated and supported by a plurality of pillars. One or both of the decks may include one or more deck panels that define a support surface and span across a length of a portion of the length of the deck. In some embodiments, the deck panels may be substantially the same so that any panel may be used at any location on the deck. The pillars provide additional strength and rigidity to the frame. The pillars may also be substantially the same so that any pillar may be used at any location on the pallet.

Optionally, the pallet may also include one or more lower deck panels connected to the lower deck. In some embodiments, the lower deck panels may be substantially the same as the upper deck panels. However, in other embodiments, the lower deck panels may be different from the upper deck panels and may include a different finish, length, shape, or the like. In these embodiments, the lower deck panels may be specifically configured to be positioned on the lower deck.

In some embodiments, the frame may include rounded edges and/or corners. The rounded edges and/or corners act to increase the stiffness of the pallet, decrease the damage risk, as well as provide an aesthetic appeal. For example, the rounded edges and/or corners help to prevent damage to the pallet if the pallet is dropped on its edge or corner by distributing the forces at impact more evenly throughout the pallet. The rounded edges and/or corners may also allow the pallet to be slid along a surface (e.g. along the ground or against another pallet) more easily than conventional pallets because the rounded edges may be less likely to snag on the floor and the curvature makes them easier to push.

To assemble the pallet, the frame is first assembled and then the deck panels are connected to the frame. For example, to assemble the frame the pillars are arranged in parallel rows and an upper end of each pillar is connected to the upper deck and a bottom end of each pillar is connected to the lower deck. The pillars and the two decks may be connected using a number of different fasteners, such as, but not limited to, screws, nails, or rivets. In embodiments having dimples, the pillar dimples are aligned with the deck dimples and one or more fasteners, such as screws, nails, or rivets, secure the pillars to the decks. As will be discussed in more detail below, in some embodiments, the dimples of the pillars and the dimples of the decks can be nested together and then connected via one or more fasteners.

Once the frame is connected the deck panels are connected thereto. For example, the deck panels may be aligned generally perpendicular to the pillars and positioned at one or more discrete locations of each deck. In particular, the deck panels may be spatially distributed across the entire length or width of the decks at substantially equidistance distances. In one embodiment, the deck panels may seat on a ledge or shelf defined by each of the decks such that the exterior surface of each deck panel is flush with an exterior surface of each deck. However, in other embodiments, the deck panels may be overlaid on either the exterior or interior of the top or bottom deck.

The assembly features, such as the predefined fastening apertures and the dimples in the pillars and/or decks, allow the pallet to be assembled quicker than conventional pallets. This is because the assembly features assist a user in aligning the various components of the pallet prior to securing them with the fasteners. This helps to reduce alignment errors when a user is connecting the pallet together. Further, the pallet may be self-jigging and self-aligning so that a specialized jig or other assembly structure is not required in order to assemble the pallet together.

In some embodiments the pallet may be configured such that the fasteners may be removable or the components may be selectively disconnected from one another. As one example, the fasteners may be rivets that may be removed from the dimple apertures to disconnect the decks and the pillars. As the fasteners may be removed, which allows the components of the pallet to be disconnected, the pallets may be repaired and/or refurbished. Conventional pallets are generally connected together with a more permanent connection mechanism (e.g., welds, adhesive, nails, etc.) and a pallet is typically destroyed if a component is damaged. However, because removing the fasteners can disassemble the pallet of the present disclosure, a damaged component can be replaced with a non-damaged component, e.g., the pillars may be removed and replaced. This allows the undamaged components of a damaged pallet to be easily reused.

In some embodiments, the various components of the pallet may be identical or substantially identical. For example, each deck may be substantially similar to other decks, each pillar may be substantially similar to the other pillars, and the deck panels may be substantially similar to each other. By having the various components of the pallet be substantially the same, the pallet may have fewer specialized components, allowing pallets of various sizes and lengths to be created from various groupings of components. In these embodiments, a pallet may be repaired with components from other pallets and so the speed of assembly for the pallet may be increased as compared to conventional pallets as each component may be interchangeable. Thus, a user may not have to identify the specific deck (e.g., the upper deck vs. the lower deck) prior to assembly.

However, in some embodiments, the upper deck may be configured differently than the lower deck. For example, the lower deck may have a webbing base that is substantially wider than a webbing base of the upper deck to allow the forces to be distributed over a wider area. Additionally, the lower deck may have a thickness configured to allow the wheels of a pallet jack or other tool to easily traverse over. In these examples, the wheels of the pallet jack may easily travel over the lower deck, whereas the upper deck may be thicker. If additional rigidity or strength of the pallet is needed, the lower and/or upper deck may have an increased thickness that provides this strength.

In some embodiments, the various components of the pallet may be constructed in a base shape that permits multiple configurations of the pallet. For example, the pillars may be constructed in a general L-shape. The general L-shape allows the pillars to be located in any location on the pallet. In some embodiments, one L-shaped pillar may be used as a corner pillar, two L-shaped pillars may be aligned back-to-back to form a T-shaped perimeter pillar, and four L-shaped pillars may be aligned to form an X-shaped center pillar. This allows the pallet components to be manufactured with less cost and varied easily without requiring retooling or reconfigurations of the machinery and/or pallet. Similarly, the decks may be connected together to form a pallet with substantially any desired dimensions. In this manner, the pallet may be customized based on the size of the goods, better supporting the item to be shipped and/or moved.

One or more components of the pallet can be formed of a weather-resistant material. For example, the components may be composed of roll-formed steel, metals (aluminum), alloys, composites (e.g., composites created through a pultrusion process), fiberglass, plastics, or the like. By using steel and other materials that may be generally weather resistant (e.g., capable of being exposed to water, snow, ice, etc.), fire resistant, or the like, the pallet can be used in harsh weather conditions. For example, conventional wood pallets may suffer performance issues when used in snow and ice environments where the snow/ice melts during the day and refreezes at night. Continuing with this example, in instances where the pallets are seated on snow/ice that subsequently melts and then refreezes, when the wood pallets are lifted by a fork lift or other lifting mechanism, the wood (which may be frozen to the snow/ice) may break, destroying or damaging the pallet. On the contrary, the pallet of the present disclosure may be formed of steel and be sufficiently strong enough to overcome the forces exerted by the ice and thus may not be damaged in this example. Moreover, the pallets may be waterproof, aseptic, and resistant to insect damage. The pallet components may also be painted, coated with specialized coatings, etched, powder-coated, or the like, in order to provide aesthetic benefits and/or other benefits (e.g., non-slip coatings, etc.).

In addition to being able to be assembled by a user, in some embodiments, the pallet may be assembled by a server table, robotic assembly, or other assembly machine, including one or more automated motors or servos that can fold the materials as desired.

In some embodiments, the thickness of the material and/or flexibility of the material may be varied to allow the components to be folded by a user. For example, a stitch cut or other types of peroration (typically done by a laser, but not necessarily), may be defined in the material segments. This allows the material to be bent by a user, such that certain components of the pallet may be shipped as substantially flat material blanks and then may be folded by a user into the desired shapes forming the joists, frame segments, deck boards, and so on. The stitch lines or perforations may be defined at fold locations for each component, to illustrate to a user where to fold the material, as well as allow the user to more easily fold the material in the desired direction.

The pallet of the present disclosure may also be able to be manufactured in a variety of different materials having different strengths, gauges, densities, thicknesses, sizes, weights, or material properties that may be selected for desired properties of the pallet. Similarly, the components of the pallet may be scaled up or down in size based on the desired dimensions of the pallet without affecting many aspects of the pallet configuration, allow for manufacturing of the pallet to be quickly scaled up or down without requiring the pallet to be redesigned. This allows the components of the pallet to be manufactured and varied easily without requiring retooling or reconfigurations of the machinery and/or pallet. Additionally, the pallets can be produced in substantially any dimensions, allowing for the size of the pallet to be customized based on the size of the goods. Conventional pallets typically come in limited dimensions and often goods are shipped that either overhang the pallet In some embodiments, each pallet may include a unique identifier. The unique identifier may be determined by a random number generator or algorithm and may include data corresponding to the date of manufacture of the pallet components, original shipment date of the pallet from a first location to a second location, the types of goods, number of goods, or substantially any other data that may be desired. The unique identifier may be written, carved, engraved, or embedded (e.g., radio frequency identification "RFID") into the pallet. As one example, the unique identifier may be written in indelible ink onto one or all of the components of the pallet. As another example, the unique identifier may be incorporated into a passive RFID component that is connected to or embedded with the material forming one or more components of the pallet.

In embodiments where the pallet includes a unique identifier, the pallet and the goods/products it is carrying may be more easily tracked to help reduce counterfeiting, lost pallets, or the like. The unique identifier may be a number, number-letter combination, a barcode, matrix barcode, pattern, design, or substantially other configurations that may be used to include data and may be assignable to a number of different items, e.g., pallets.

The pallet may also include one or more strengthening components. For example, in some embodiments, a webbed or space frame web structure may be incorporated in the decks and at least some of the pillars. The space frame may be a lightweight rigid structure constructed from interlocking beams and/or struts with profile shapes that enhance the rigidity of the pallet (e.g., its bending stiffness) without adding substantial weight to the pallet. According to the present disclosure, bending moments within the decks and at least some of the pillars are transmitted as tension and compression loads along the length of each beam or strut. When the pallet is fully assembled, the space frame web structure may seamlessly connect the upper deck, the lower deck, and the pillars together in a webbing structure. The webbing structure may have a profile shape that resists bending and transfers loads along the length (whether linear or curvilinear) of the webbing structure and throughout the pallet. The webbing structure provides strength, while also being lightweight as one or more webbing apertures may be defined by the structure of the frame. In one embodiment, the strengthening component may be located in a central region, such as the central frame portion of the pallet. However, in some embodiments, the strengthening component may be located at an area where additional structural support is desired. For example, the strengthening component may also be incorporated in the deck panels and decks.

In one example, the shape or cross-section of the frame components may be varied to increase rigidity. For example, the shape of the frame components may be modified to be complex such as including multiple bends or folds, which act to increase the overall rigidity of the frame component. As a specific example, one or more of the ribs or other elements may have, without limitation, a U, T, or I-shaped profile that enhances the rigidity. The profile or cross-section shape that the components are formed into may vary based on the needs for the specific pallet and may be in addition to the overall shape of the component. For example, the pillars may be generally longitudinal members but may be formed so as to have a T or U shaped profile to increase the rigidity.

In some embodiments, the strengthening component is integrally formed in the various components of the pallet. However, in other embodiments, the strengthening component may be a separate element joined to the pallet components by adhesive, heat or sonic welds, mechanical fasteners, or any other suitable means for joining elements together. Because the strengthening columns may be added when and where desired, the pallet may be customized based on the load to be transported, and the additional material and costs of the strengthening column may not be added unless desired.

It should be noted that although the following description is discussed with respect to a pallet for shipping and/or moving, in other embodiments, the pallet may be used in other applications. For example, two or more pallets may be connected together to form structures for other items, such as houses, shelters, and so on. As a specific example, multiple pallets may be stacked together vertically to form a wall for a housing structure, wall coverings, such as shingles, mud, tiles, etc. may be connected to the upper deck and lower deck to cover the pallets and provide an aesthetically pleasing appearance. As such, the discussion of any particular application of the pallet structure disclosed herein is meant as illustrative only, as many other applications are envisioned.

DETAILED DESCRIPTION

Turning now to the figures, FIGS. 1A-5 illustrate various views of a first example of a pallet of the present disclosure. With reference to FIGS. 1A-5, the pallet 100 may include a frame 236 and a plurality of deck panels 106 connected thereto. The frame 236 may include a plurality of pillars 102 spaced between and connected to an upper deck 104A, which may be referred to as a first deck, and lower deck 104B, which may be referred to as a second deck. As shown, the pillars 102, which may be referred to as deck posts or struts, may be arranged parallel to each other and perpendicular to the upper deck 104A and the lower deck 104B. In some embodiments, the pillars 102 may be spatially separated from one another by a distance to provide support at various locations along the perimeter of the pallet. The pallet also includes a plurality of tine apertures 108 formed between the pillars 102 and bounded by the upper deck 104A and the lower deck 104B to receive a tine(s) of a forklift. The tine apertures 108 are configured to receive the tines of a fork lift or other lifting mechanism that may be used to lift or move the pallet.

Each of the various components of the pallet 100 may be constructed out of the same material or different materials. In some examples, each of the pallet components may be formed out of steel or other metal alloys that allow the components to withstand harsh environmental conditions, be fire resistant, and have increased strength as compared to conventional wood pallets. However, as will be discussed in more detail below, the structural characteristics of the pallet 100 allow it to be sufficiently lightweight, while maintaining the strength of the materials.

Figure 5:
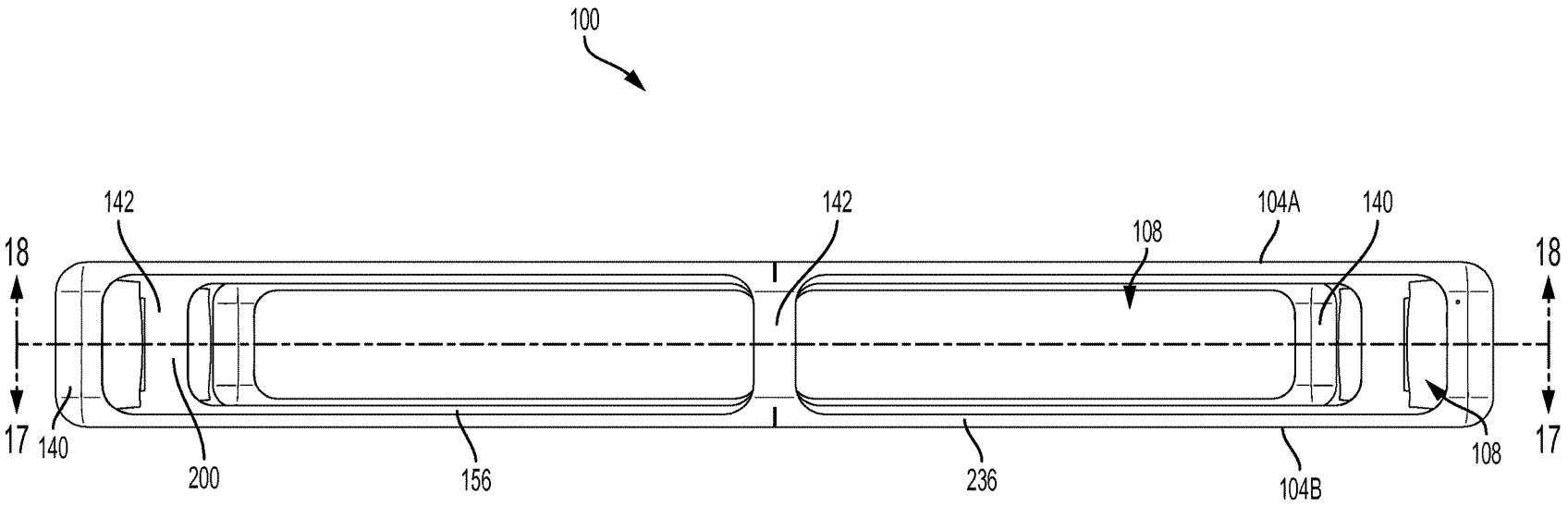
FIG. 5 is a side elevation view of the pallet of FIG. 1A.
Figure 6:
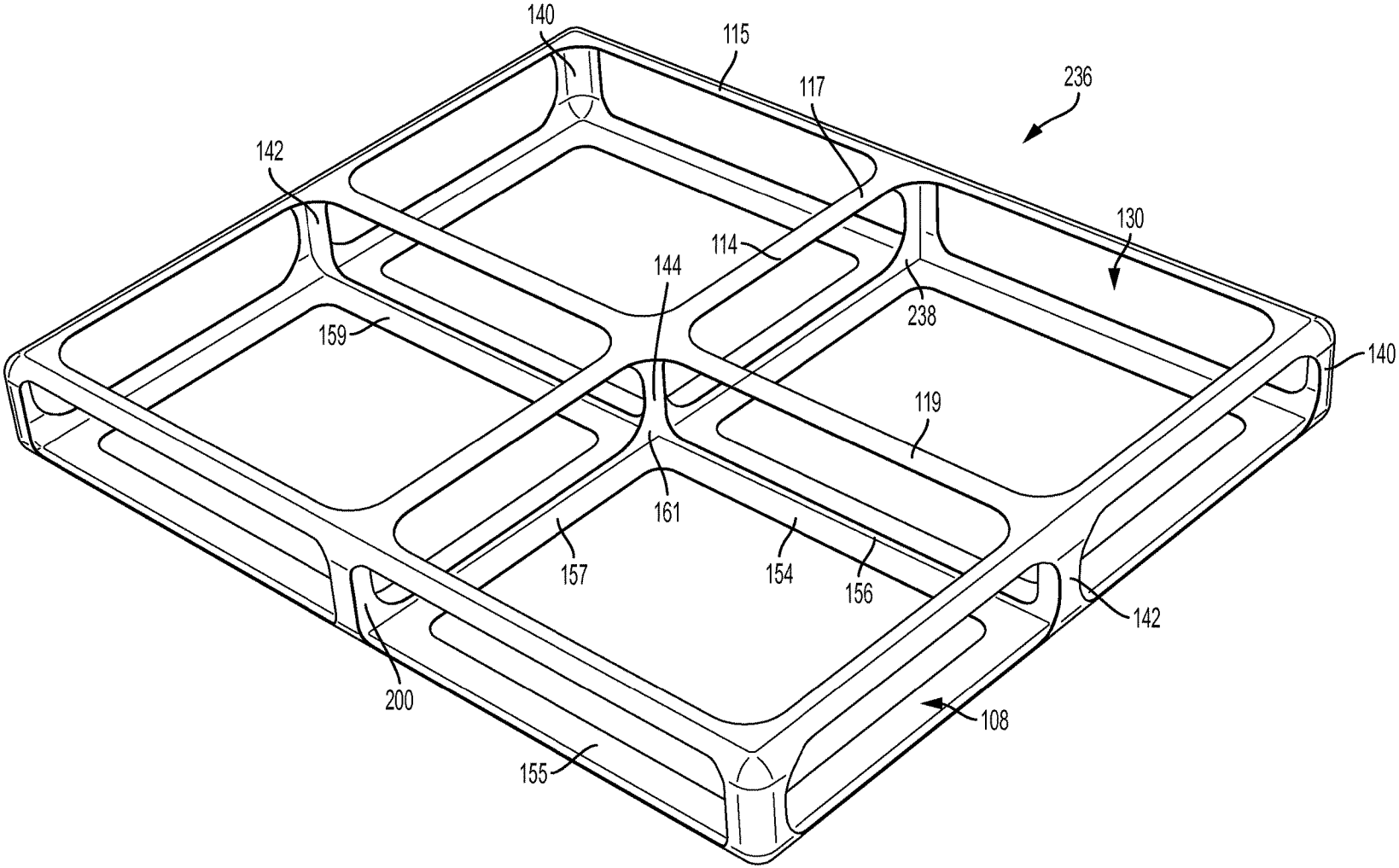
FIG. 6 is a top isometric view of the pallet of FIG. 1A with the deck panels removed.
Figure 7:
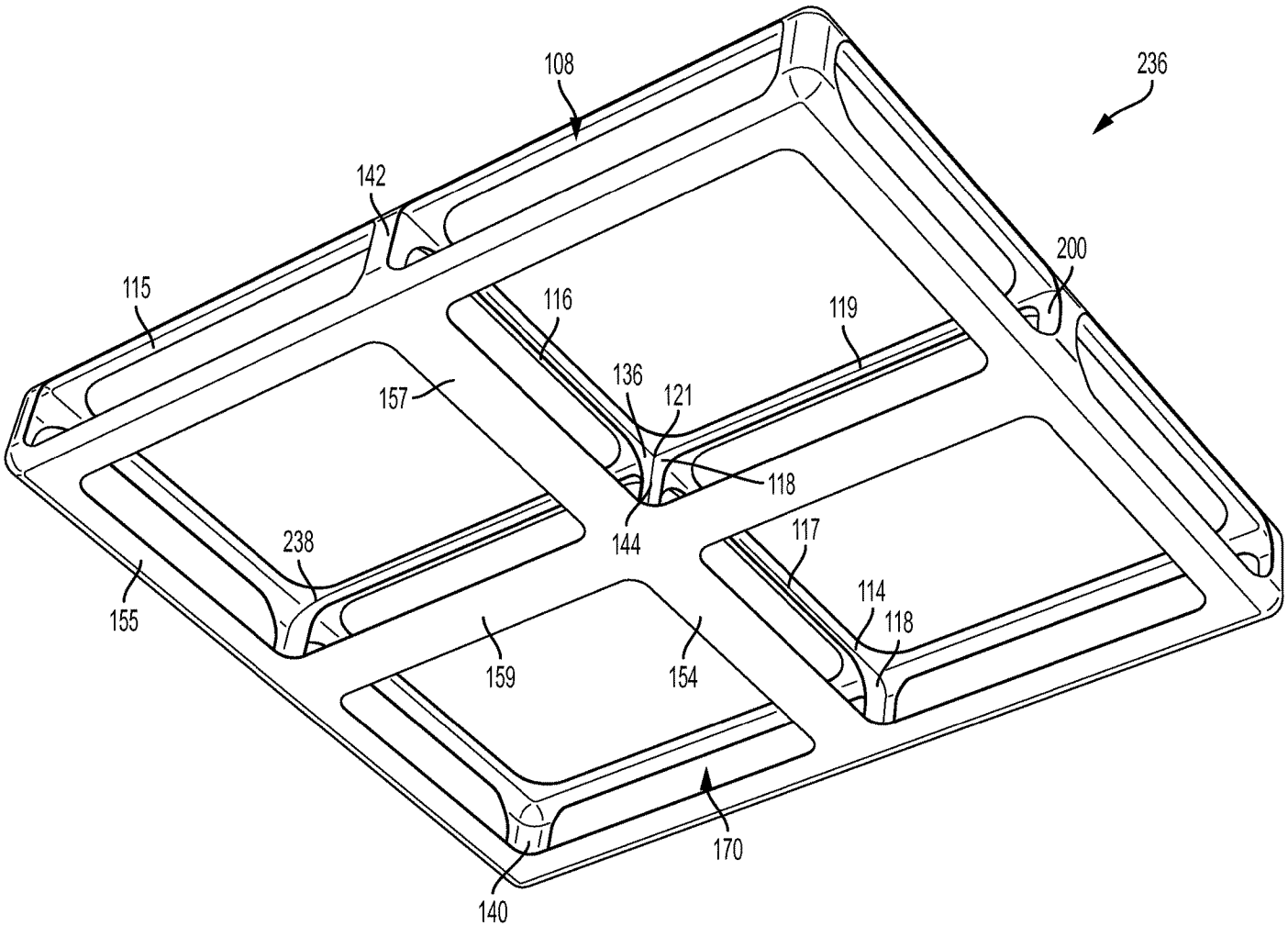
FIG. 7 is a bottom isometric view of the pallet of FIG. 6.

With reference to FIGS. 5-7, the upper and lower decks 104A, 104B are arranged parallel to one another and define both a length and a width dimension of the pallet 100. In some embodiments, the length dimension of the pallet 100 may be greater than the width dimension, forming a pallet of a non-equilateral shape (e.g. a rectangle). In other embodiments, however, the length and width dimensions may be generally equal to one another. As shown in FIGS. 5-7, the pallet 100 may include an upper deck 104A and a lower deck 104B, but in other embodiments the lower deck or portions thereof may be omitted.

With continued reference to FIGS. 5-8 the upper deck 104A has an upper exterior surface 110 and an upper interior surface 112. The upper deck 104A includes an upper webbing base 114 that provides structural support for the frame 236 and a plurality of upper peripheral members 115 (e.g., four upper peripheral members 115) that define the outer periphery or perimeter of a portion of the pallet 100 (e.g., the upper deck 104A) and intersect with the upper webbing base 114. For example, the upper webbing base 114 includes a first beam 117, which may be referred to as an upper longitudinal beam, that extends across a longitudinal length of the pallet 100 and a second beam 119, which may be referred to as a second upper longitudinal beam and may intersect the first beam 117 at an upper intersection 121 (see FIG. 7), that extends across a width of the pallet 100, and the upper peripheral members 115 connect the ends of each beam 117, 119 to form the outer portion of the upper deck 104A. As shown, the first beam 117 may be connected to two of the upper peripheral members 115, and the second beam 119 may be connected to the other two of the upper peripheral members 115. One or more upper deck apertures 130 are defined by the intersections of the beams 117, 119 and the upper peripheral members 115. In one example, the upper deck 104A may include four equally sized upper deck apertures 130, but in other examples fewer or more apertures may be defined. As shown in FIGS. 5-8, the upper deck apertures 130 are spatially separated from one another by a first spacing distance.

Because the upper deck 104A may be formed by the intersection and connection of beams 117, 119, rather than a solid uniform component, the pallet 100 may be lighter weight than conventional pallets as the apertures 130 may be sized so as to allow a desired reduction in weight while maintain sufficient thickness in the beams 117, 119 and periphery members 115 to provide the desired structural support.

In one embodiment the two beams 117, 119 intersect one another at approximately a center point of the pallet 100. In this embodiment, the upper webbing base 114 defines a cross or X shape. Additionally, the ends of each of the beams 117, 119 may increase in width as they approach the upper peripheral members 115 and the intersection of the two beams 117, 119. The increased material at these intersection locations helps to provide additional strength and rigidity to the upper deck 104A.

With continued reference to FIGS. 5-8, the upper peripheral members 115 each may define a perimeter edge 126 that faces outward away from the center of the pallet 100 and a plurality of perimeter corners 128. The perimeter edge 126 and corners 128 may be rounded to increase the stiffness of the upper deck 104A and distribute forces more evenly within the pallet 100 should the pallet 100 be dropped on its edge or corner. The rounded edge 126 and corners 128 may have any curve radius. However, in some embodiments, the rounded edge 126 and corners 128 have a 1-1½" curve radius. In some embodiments, just the outer facing corners 128 and edges 126 may be rounded, but in other embodiments, the interior facing corners 128 and edges 126 may also be rounded. For example, as shown in FIG. 6, the interior corners of the beams 117, 119 and periphery members 115 may be rounded to define upper deck apertures 130 that are substantially rectangular but with rounded corners.

The upper deck 104A may also include a plurality of upper corner pillar members 132, a plurality of upper perimeter pillar members 134, and one or more upper center pillar members 136. The upper corner pillar members 132, upper perimeter pillar members 134, and upper center pillar members 136 extend a distance inwardly when the pallet 100 is assembled. The upper corner pillar members 132, upper perimeter pillar members 134, and upper center pillar members 136 may be integrally formed with the upper deck 104A, or may be separate elements joined to the upper deck 104A by adhesives, heat or sonic welds, mechanical fasteners, or any other suitable means for joining elements together, or any combination thereof.

The upper corner pillar members 132, upper perimeter pillar members 134, and upper center pillar members 136 may have a pillar connection portion 138 configured to connect to a corresponding corner pillar 140, perimeter pillar 142, or center pillar 144, respectively. With reference to FIGS. 1A-38, the pillar connection portion 138 may further comprise fastening apertures 146 to facilitate connecting the pillar connection portion 138 to the pillars 102, as more fully explained below. With reference to FIGS. 1A-38, the pillar connection portion 138 of the upper pillar members 132, 134, 136 may further comprise a lap joint receiving portion 148 configured to correspond with a lap joint mating surface 224 of the pillars 102.

The upper An upper webbing ridge 116 may extend perpendicularly inward from the upper webbing base 114 and may extend the entire longitudinal length of the upper webbing base 114. The upper webbing ridge 116 has a narrower width than the upper webbing base 114 and may extend from approximately a centerline of the webbing base 114 so as to bisect the upper webbing base 114.

Figure 11A:
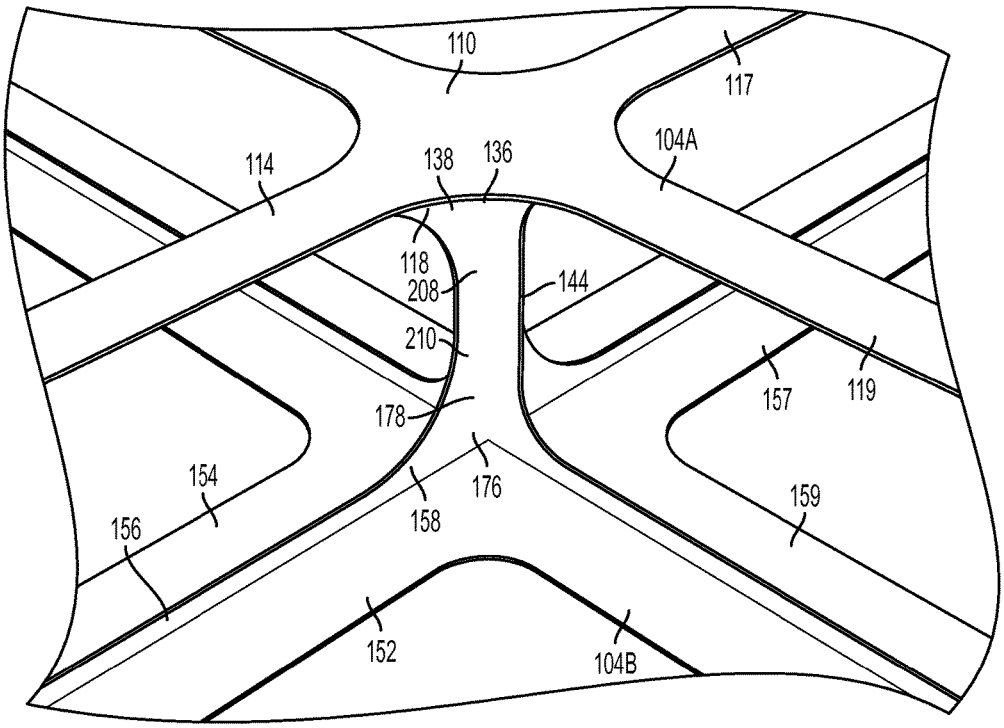
FIG. 11A is an enlarged view of one example of a center pillar of the pallet of FIG. 6.
Figure 11B:
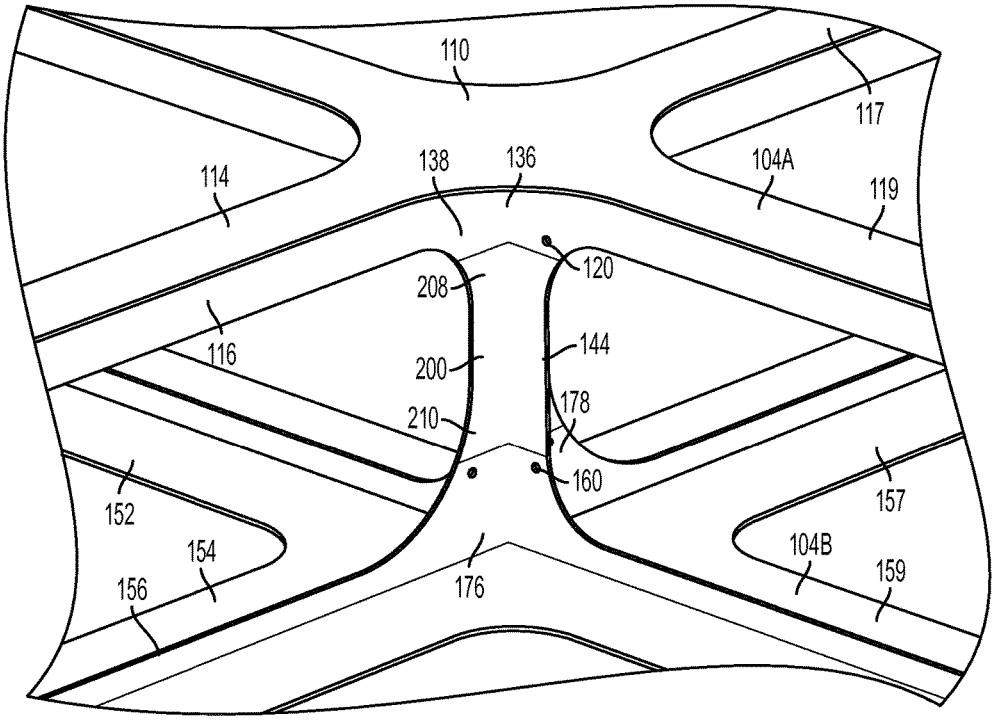
FIG. 11B is an enlarged view of another example of a center pillar of the pallet of FIG. 6.
Figure 12:
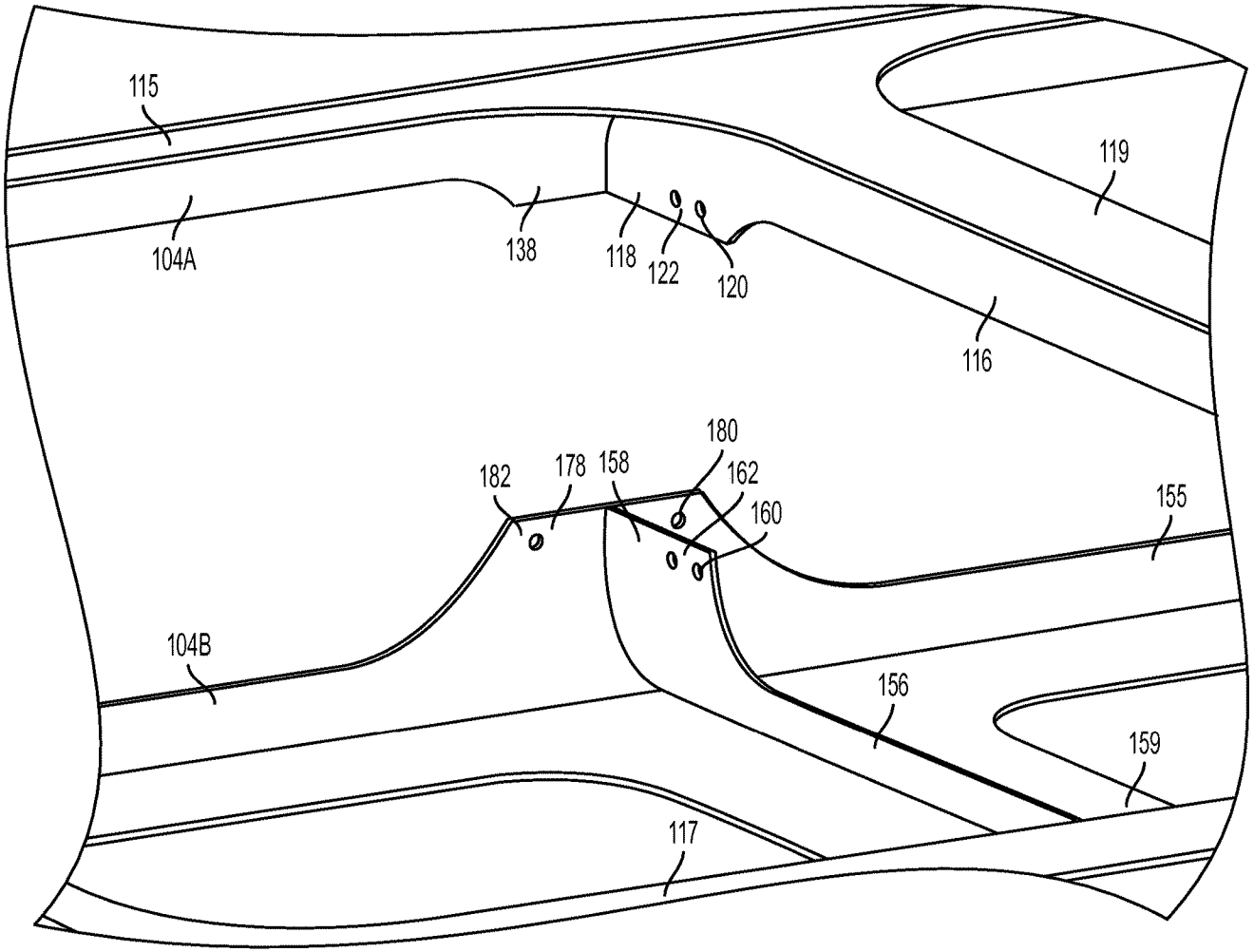
FIG. 12 is an enlarged view of the pillar and webbing connection portions of the upper and lower perimeter members of the pallet of FIG. 6 with the perimeter pillar removed.
Figure 13:
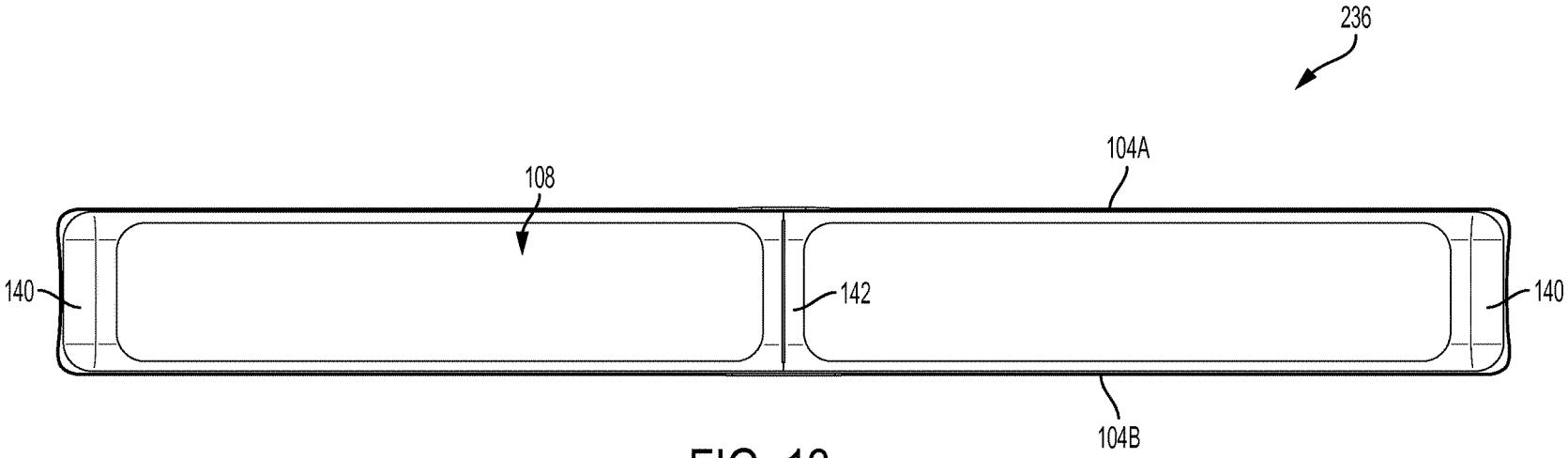
FIG. 13 is a cross-sectional view of the pallet of FIG. 6 viewed along line 13-13 in FIG. 8.
Figure 14:
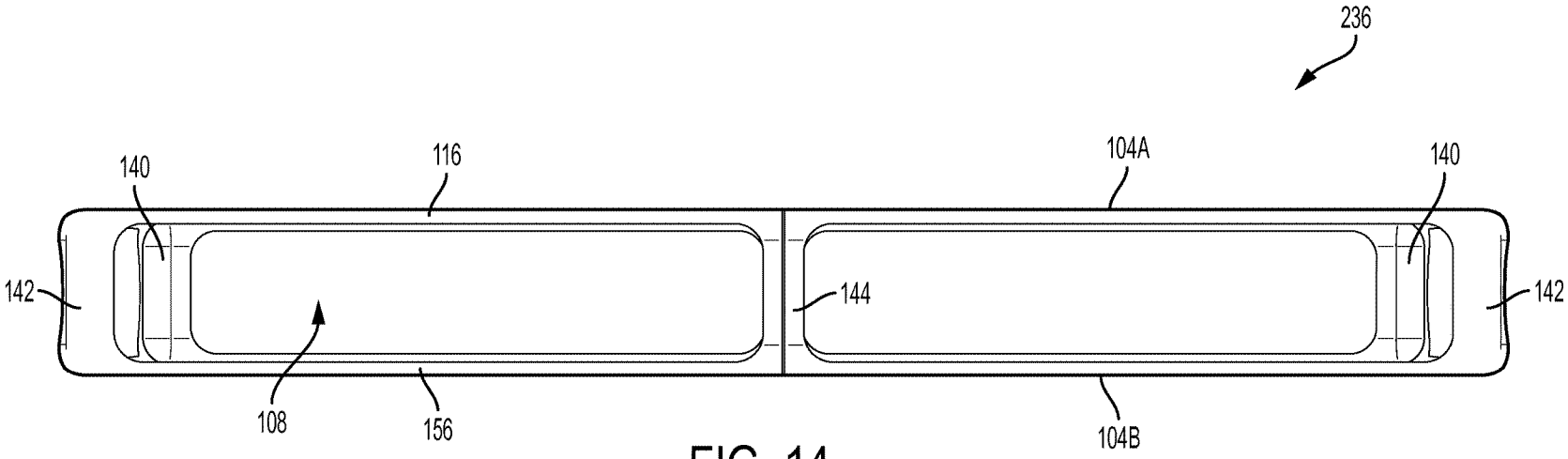
FIG. 14 is a cross-sectional view of the pallet of FIG. 6 viewed along line 14-14 in FIG. 8.
Figure 15:
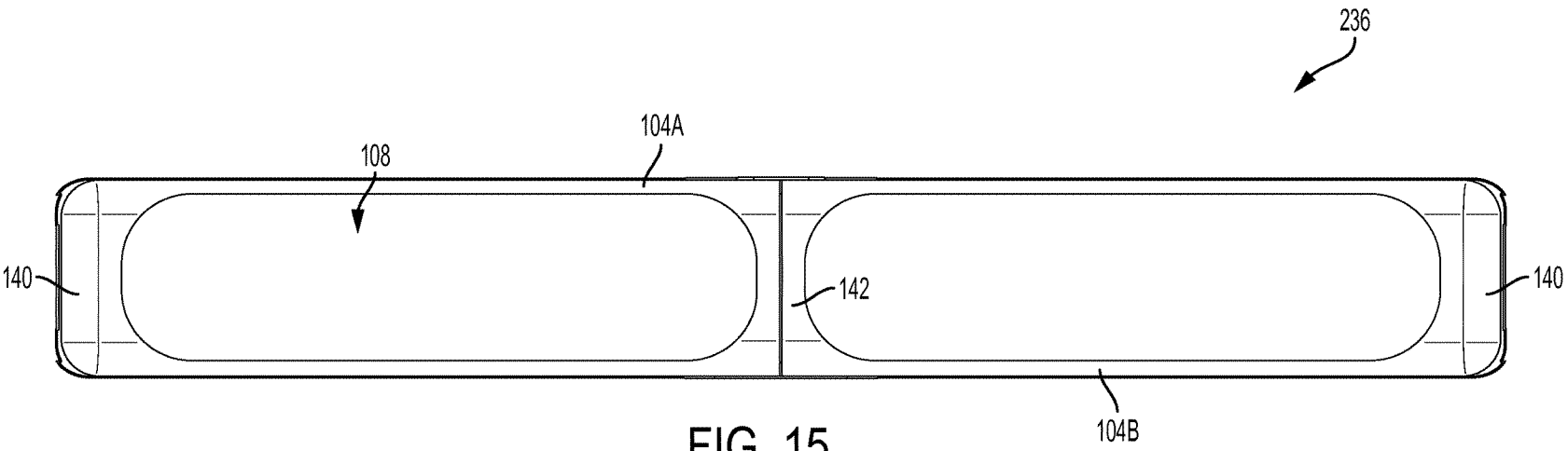
FIG. 15 is a cross-sectional view of the pallet of FIG. 6 viewed along line 15-15 in FIG. 8.
Figure 16:
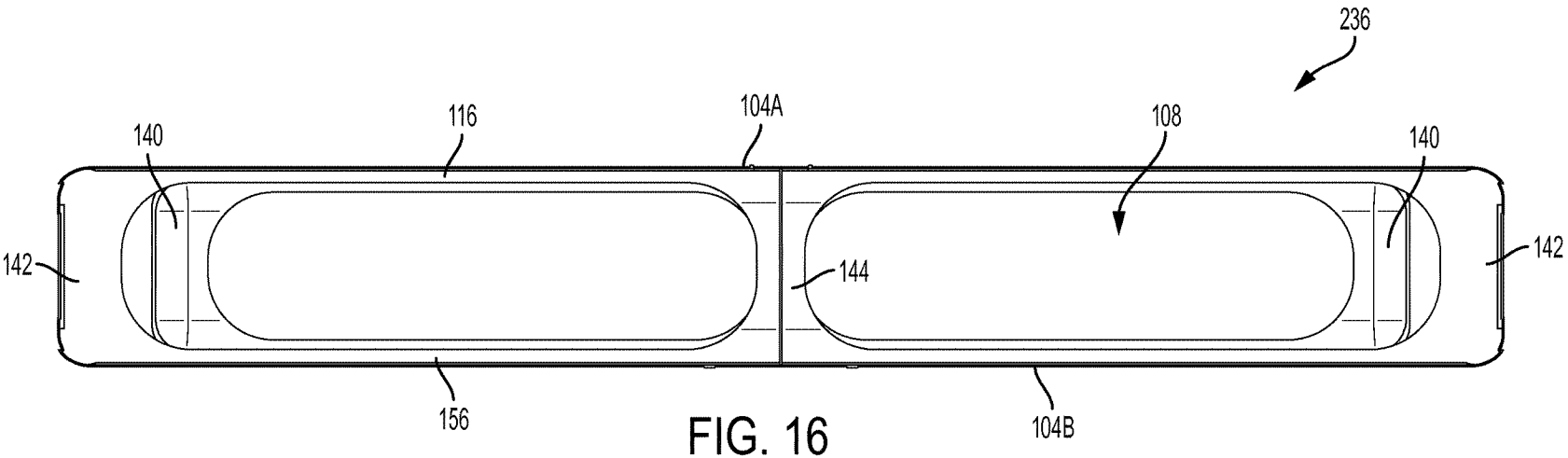
FIG. 16 is a cross-sectional view of the pallet of FIG. 6 viewed along line 16-16 in FIG. 8.
Figure 17:
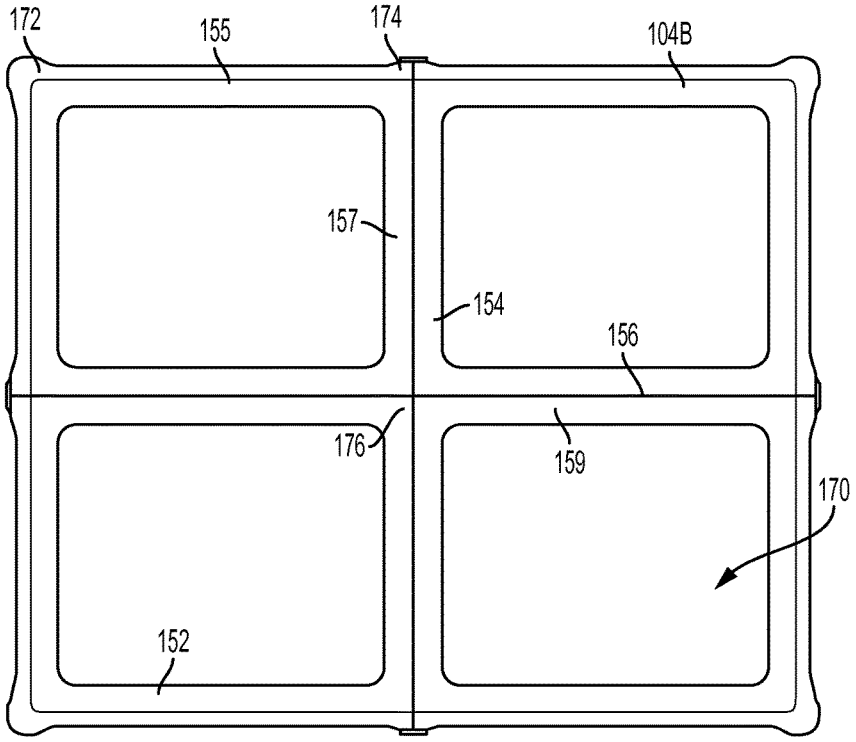
FIG. 17 is a cross-sectional view of the pallet of FIG. 6 viewed along line 17-17 in FIG. 5.
Figure 18:
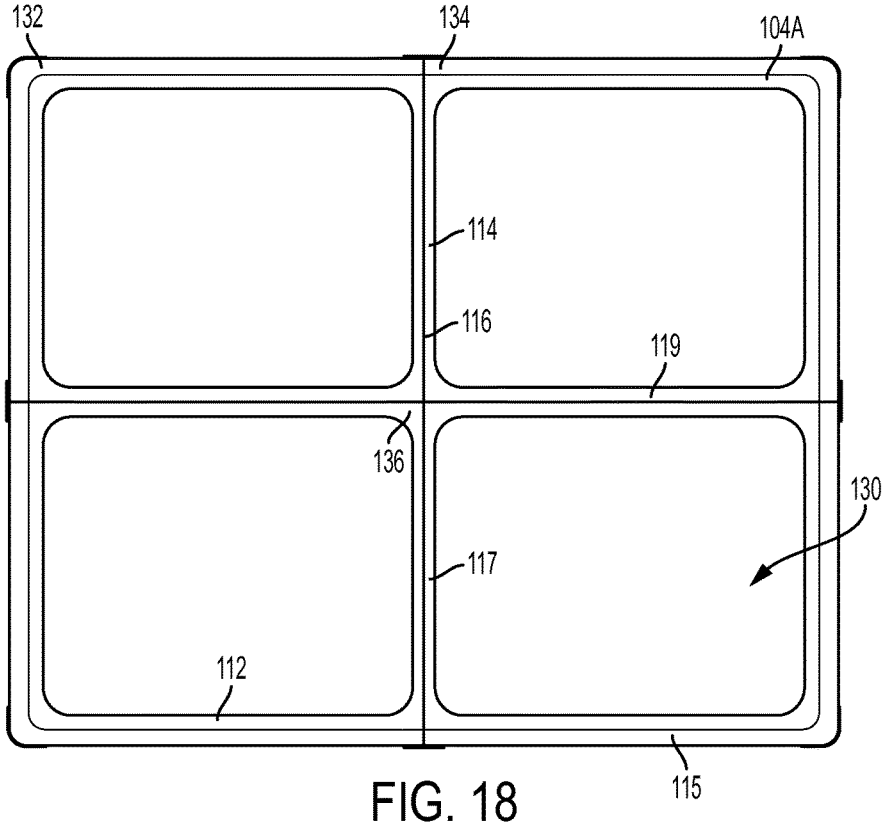
FIG. 18 is a cross-sectional view of the pallet of FIG. 6 viewed along line 18-18 in FIG. 5.

With reference to FIGS. 7 and 11B, the upper webbing ridge 116 includes an upper webbing connection portion 118 that defines an interface for connecting to the pillars 102. In some embodiments, the upper webbing connection portion 118 includes fastening apertures 120 that further facilitate connecting the upper webbing connection portion 118 to the pillars 102, as explained below. Further, the upper webbing connection portion 118 may further comprise a webbing lap joint receiving portion 122 configured to correspond with an upper webbing lap joint 124 of the pillars 102, as explained below. With reference to FIG. 12, the webbing lap joint receiving portion may extend below a terminal edge of the ridge 116 and defines a bracket for connecting a pillar to the upper webbing base 114.

The upper webbing ridge 116, along with one of the beams 117, 119 defines a complex shape, in this case a T-shape profile that acts as a webbing structure. That is, central area of the beams 117, 119 and the ridge 116 define a base point with the "webs," i.e., the ridge or the top surfaces extending outward therefrom.

Figure 4:
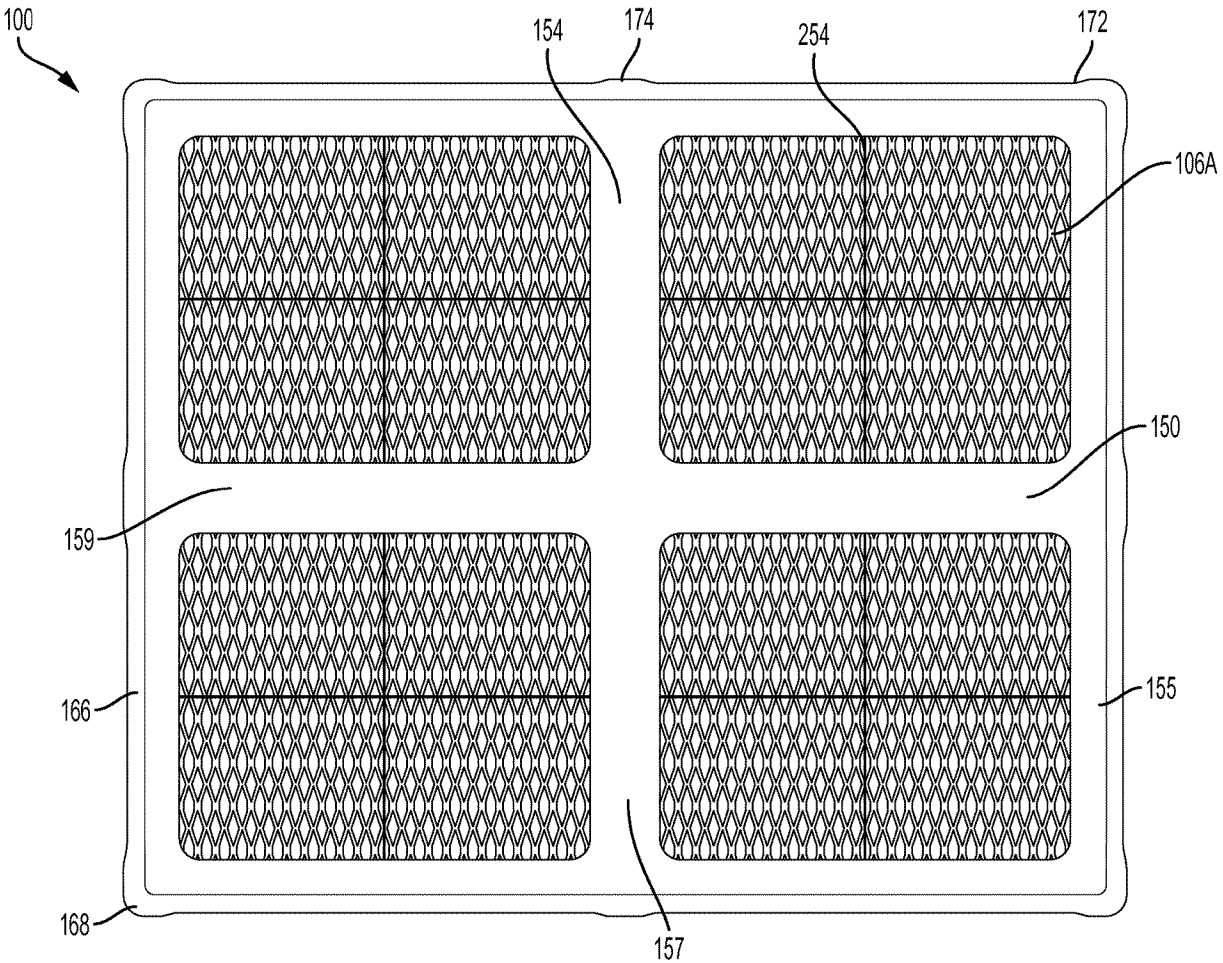
FIG. 4 is a bottom plan view of the pallet of FIG. 1A.
Figure 8:
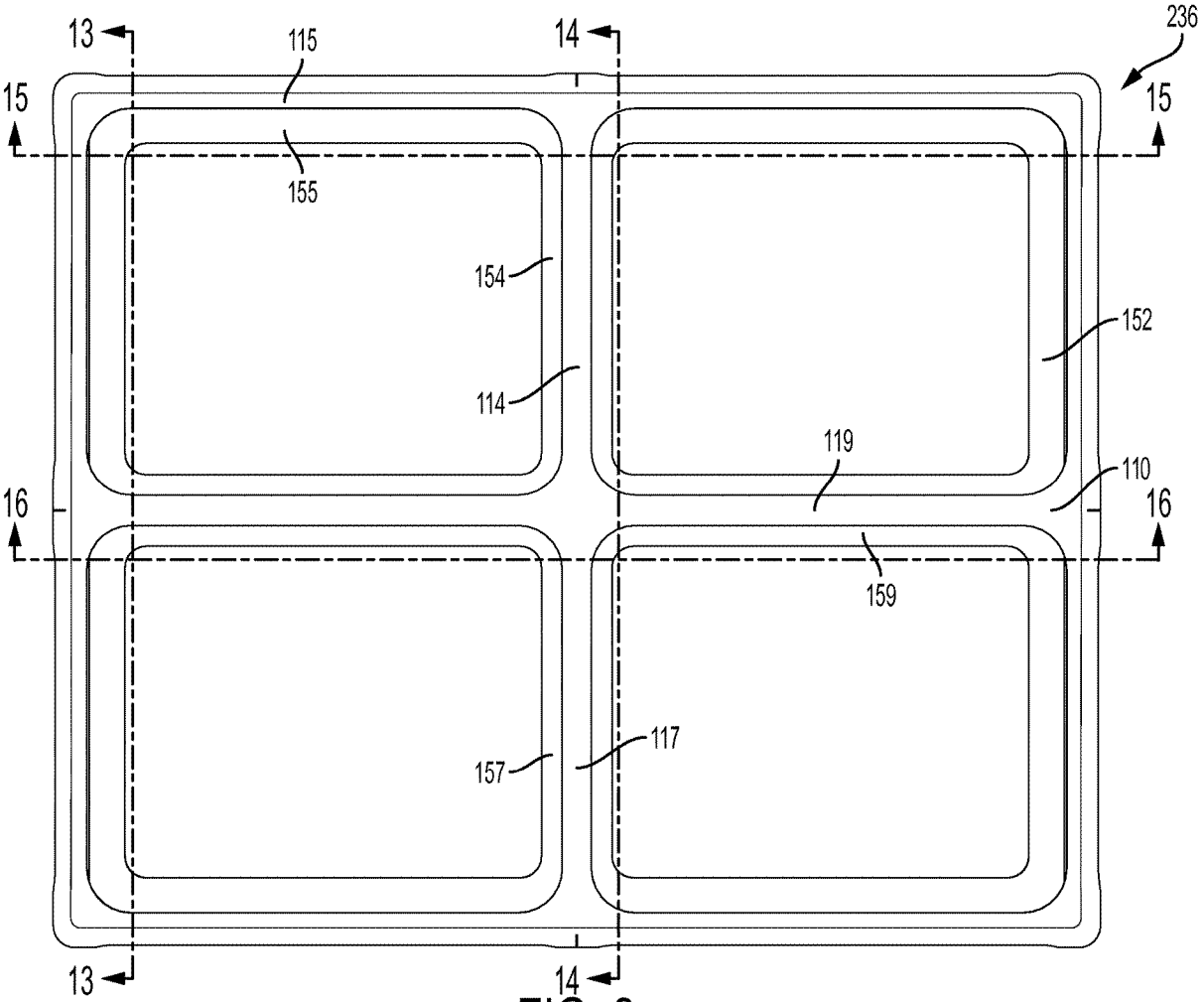
FIG. 8 is a top elevation view of the pallet of FIG. 6.
Figure 9A:
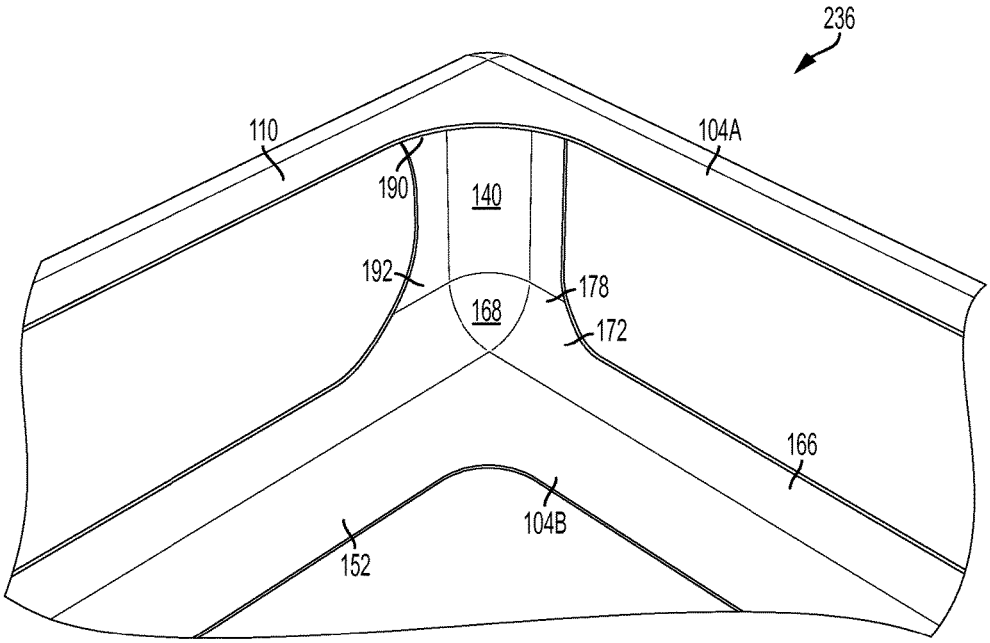
FIG. 9A is an enlarged view of one example of a corner pillar of the pallet of FIG. 6.
Figure 9B:
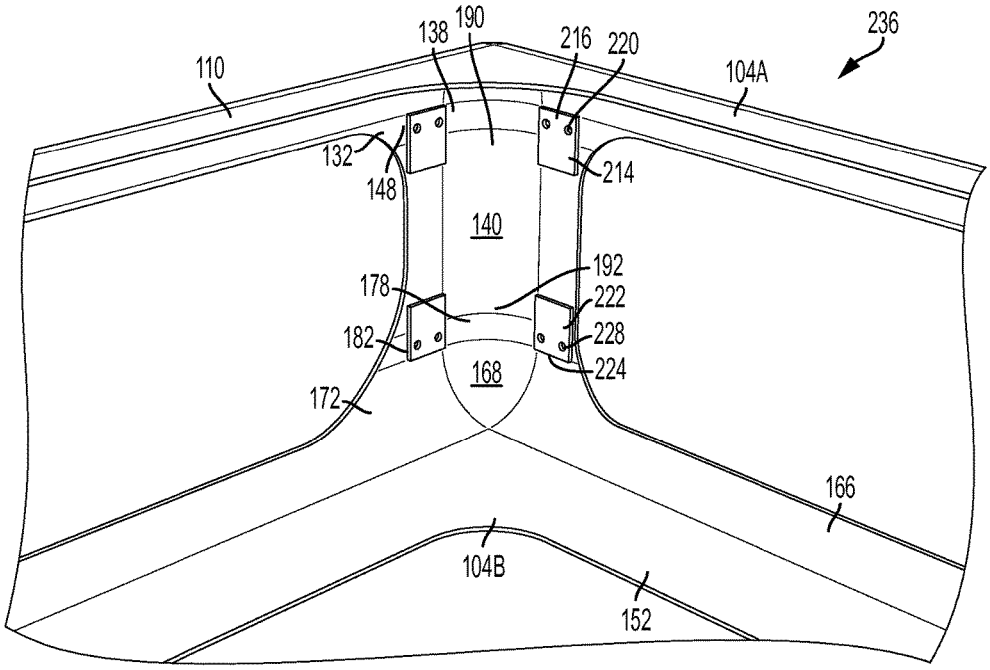
FIG. 9B is an enlarged view of another example of a corner pillar of the pallet of FIG. 6.
Figure 10A:
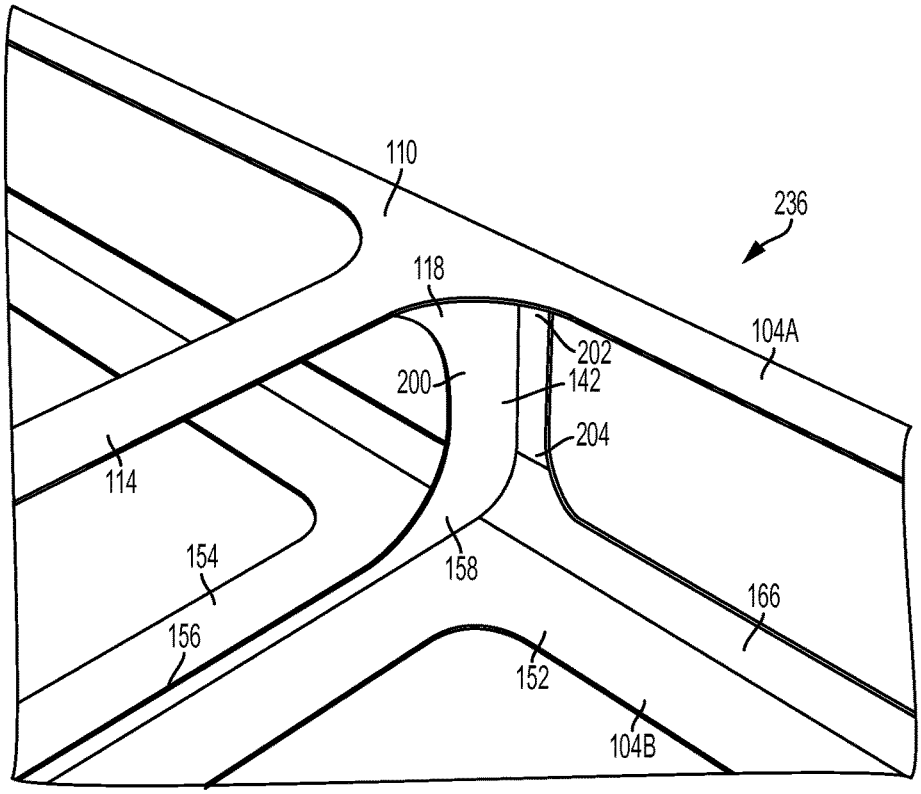
FIG. 10A is an enlarged view of one example of a perimeter pillar of the pallet of FIG. 6.
Figure 10B:
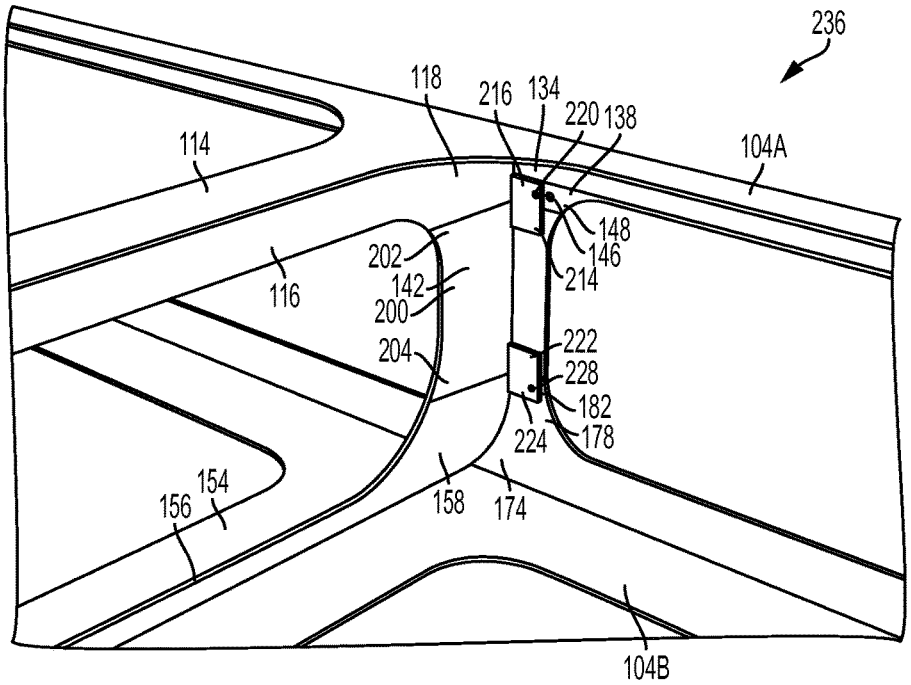
FIG. 10B is an enlarged view of another example of a perimeter pillar of the pallet of FIG. 6.

With reference to FIGS. 4, 7, and 8, the lower deck 104B will now be discussed in more detail. The lower deck 104B may be substantially similar to the upper deck 104A, but may have somewhat wider beams to provide additional rigidity to the pallet 100. However, in other embodiments, the lower deck 104B may be the same as, and interchangeable with, the upper deck 104A.

The lower deck 104A has an lower exterior surface 150 and an lower interior surface 152. The lower deck 104B defines lower webbing base 154 that provides structural support for the frame 236 and a plurality of lower peripheral members 155 (e.g., four lower peripheral members 155) that define the outer periphery or perimeter of a portion of the pallet 100 (e.g., the lower deck 104B) and intersect with the webbing base 154. For example, the lower webbing base 154 includes a first beam 157, which may be referred to as a first lower longitudinal beam, that extends across a longitudinal length of the pallet 100, and a second beam 159, which may be referred to as a second lower longitudinal beam and may intersect the first beam 157 at a lower intersection 161 (see FIG. 6), that extends across a width of the pallet 100 and the lower peripheral members 155 connect the ends of each beam 157, 159 to form the outer portion of the lower deck 104B. As shown, the first beam 157 may be connected to two of the lower peripheral members 155, and the second beam 159 may be connected to the other two of the lower peripheral members 155. In some embodiments, the beams 157, 159 and periphery members 155 of the lower deck 104B may be wider than the beams 117, 119 and periphery members 115 of the upper deck 104A. In these embodiments, the additional material on the lower deck 104B provides additional surface area that contacts the support surface (e.g., the ground) to help stabilize the pallet 100 on the support surface.

The outer periphery members 155 of the lower deck 104B define a perimeter edge 166 and a plurality of perimeter corners 168 for the lower deck 104B. The perimeter edge 166 and corners 168 may be rounded to increase the stiffness of the lower deck 104B and distribute forces more evenly within the pallet 100. For example, if the pallet 100 is dropped on its lower edge, the rounded shape of the corners 168 distributes the force to prevent damage to the pallet 100. The rounded edge 166 and corners 168 may have any curve radius; however, in an exemplary embodiment, the rounded edge and corners have a 1-1½" curve radius.

One or more lower deck apertures 170 are defined by the intersections of the beams 157, 159 and the lower peripheral members 155. In one example, the lower deck 104B may include four equally sized lower deck apertures 170, but in other examples fewer or more apertures may be defined. The lower deck apertures 170 and the upper deck apertures 130 may be generally aligned with one another. As shown, the lower deck apertures 170 are spatially separated from one another by a second spacing distance. In some embodiments, the second spacing distance may be greater than the first spacing distance to allow spatially separated supports to enhance rigidity. The spacing distances may be determined by the length and width of the upper and/or lower deck, the types of materials used for the pillars and decks, as well as a desired strength and rigidity of the pallet.

Similar to the upper deck 104A, a lower webbing ridge 156 extends perpendicularly upwards from the lower interior surface 152 of the lower webbing base 154 and may extend the entire longitudinal length of the lower webbing base 154. That is, each of the beams 157, 159 and the outer periphery members 155 may include the lower webbing ridge 156 extending along their length. The lower webbing ridge 156 may bisect the bottom of the webbing base 154 as it may extend along a centerline of the base 154. In some embodiments, the upper webbing ridge 116 on each beam 117, 119 of the upper deck 104A may be substantially parallel to and aligned above the lower webbing ridge 156 on the corresponding beam 157, 159 on the lower deck 104B.

The lower webbing ridge 156 may also include a lower webbing connection portion 158 that, as will be discussed below, defines an interface to connect to the plurality of pillars 102. The lower webbing connection portion 158 includes fastening apertures 160 that receive fasteners to connect the lower webbing connection portion 158 to the pillars 102, as explained below. The lower webbing connection portion 158 may further include a webbing lap joint receiving portion 162 configured to correspond with a lower webbing lap joint 164 of the pillars 102. As with the upper deck, the lower webbing ridge 156 defines a portion of the webbed structure for the beams of the lower deck and defines a complex shape with various angles to increase rigidity for the structure.

The lower deck 104B may also comprise a plurality of lower corner pillar connection members 172, a plurality of lower perimeter pillar connection members 174, and one or more lower center pillar connection members 176. These components may be used to secure the pillars 102 to the lower deck 104B, as will be discussed in more detail below. In some embodiments, the lower corner pillar connection members 172, lower perimeter pillar connection members 174, and lower center pillar connection members 176 extend a distance upwardly towards the upper deck 104A. The lower pillar connection members 172, 174, 176 may be integrally formed with the lower deck 104B, or may be separate elements joined to the lower deck 104B by adhesives, heat or sonic welds, mechanical fasteners, or any other suitable means for joining elements together, or any combination thereof. The lower pillar connection members 172, 174, 176 may have a pillar connection portion 178 that may include fastening apertures 180 to receive one or more fasteners to connect to the pillar connection portion 178 to the pillars 102. With reference to FIGS. 11A-12, the pillar connection portion 178 of the lower pillar connection members 172, 174, 176 may further comprise a lap joint receiving portion 182 configured to correspond with a lap joint mating surface 232 of the pillars 102. For example, the pillar connection members may intersect perpendicularly with each other to define an interface for connecting to the pillars 102.

With continued reference to FIGS. 1B and 9A-11B, the pallet 100 may also comprise a plurality of pillars 102. In particular, the pallet 100 may include a plurality of corner pillars 140, a plurality of perimeter pillars 142, and one or more center pillars 144, each of the corner pillars 140, perimeter pillars 142, and center pillars 144 having a different profile shape. The pillars 102 are positioned between the upper deck 104A and the lower deck 104B. The pillars 102 may be generally configured to match the shapes of the connection members on the upper and lower decks 104A, 104B and in some embodiments may be formed integrally with the decks or may be separate components attached thereto. The pillars may include webbed structures that define multiple surfaces angled relative to one another and connected at a generally central location.

With reference to FIGS. 27-31, each of the plurality of corner pillars 140 may be generally L-shaped in cross-section and configured to connect to a corresponding upper corner pillar connection member 132 and lower corner pillar connection member 172. In some embodiments, the corner pillars 140 may be connected to and positioned between the upper peripheral members 115 and the lower peripheral members 155 and spatially separated from the perimeter pillars 142. With reference to FIGS. 27-31, the corner pillars 140 may generally have a U or C shape (or other sufficiently rigid profile) and include two brackets on either end. The corner pillars 140 form the corner edges of the pallet 100 and each of the plurality of corner pillars 140 may have a rounded edge 184 to match the rounded corners 128 of the upper deck 104A and the rounded corners 168 of the lower deck 104B.

Figure 27:
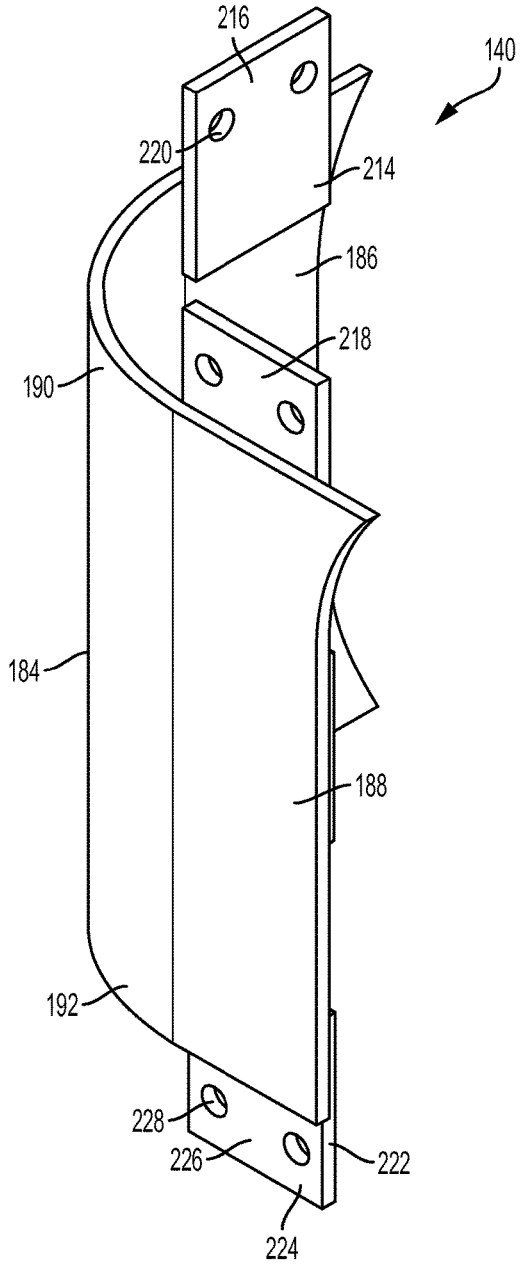
FIG. 27 is front isometric view of a corner pillar in accordance with the present disclosure.
Figure 28:
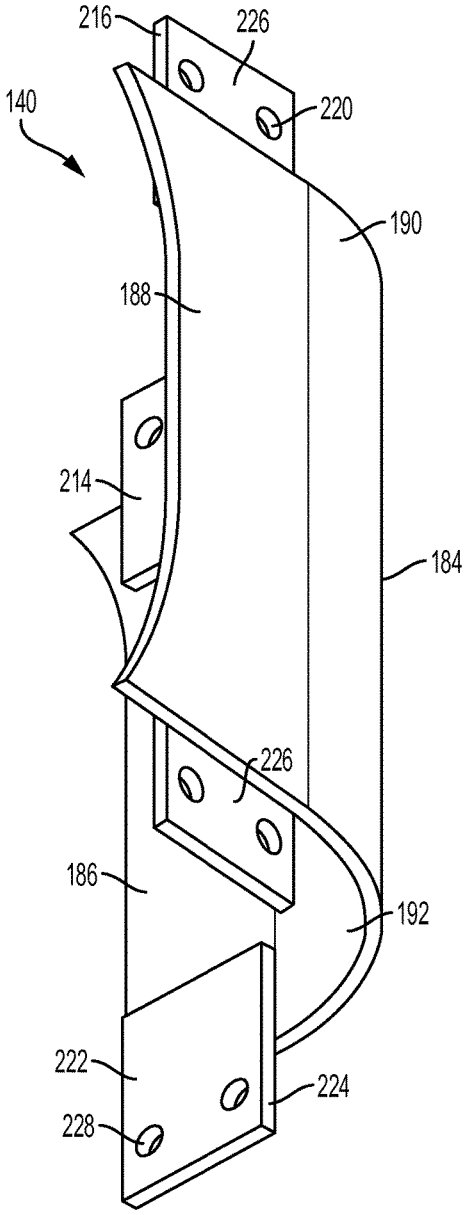
FIG. 28 is a rear isometric view of the corner pillar of FIG. 27.
Figure 31:
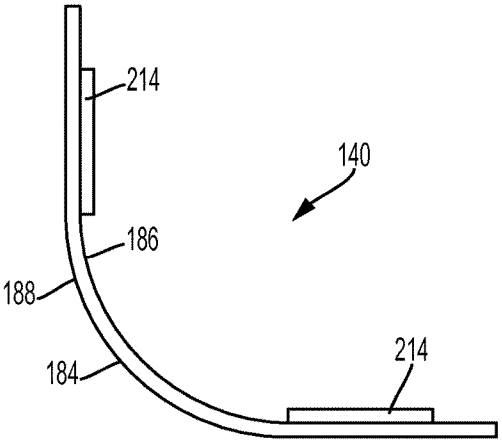
FIG. 31 is a top plan view of the corner pillar of FIG. 27.
Figure 30:
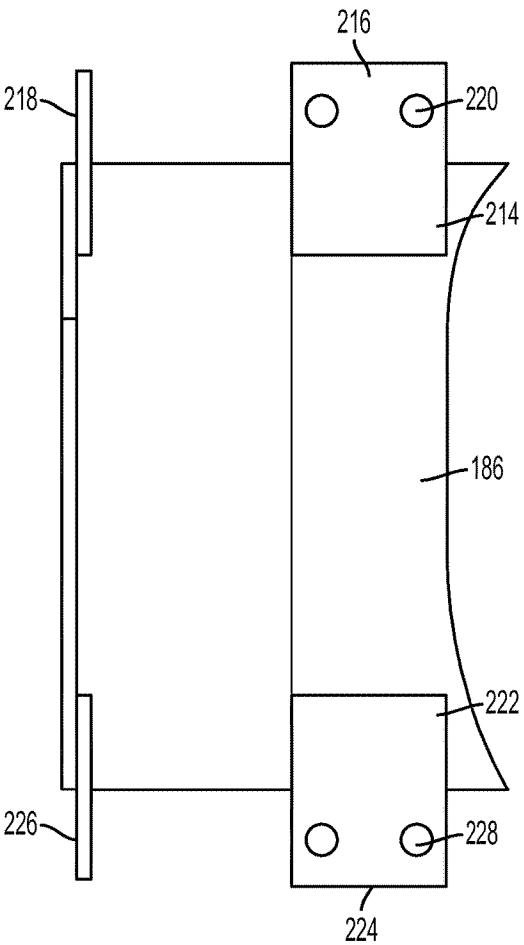
FIG. 30 is a right-side elevation view of the corner pillar of FIG. 27.
Figure 29:
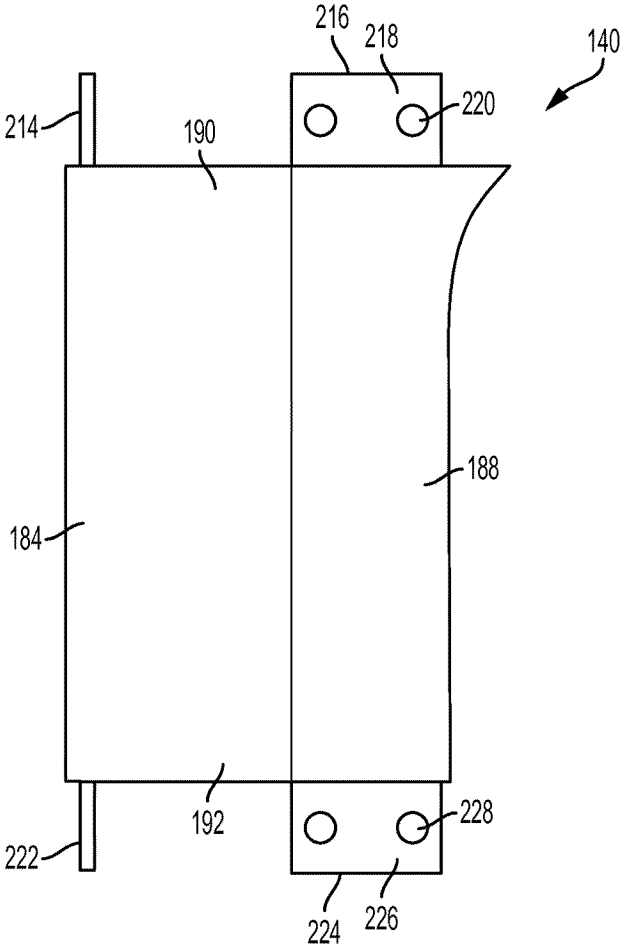
FIG. 29 is a front elevation view of the corner pillar of FIG. 27.

The corner pillars 140 have an inner surface 186 and an outer surface 188. As shown in FIGS. 27 and 28, the outer surface 188 may be rounded to define a plurality of rounded edges for the pallet 100 (see FIG. 1). The corner pillars 140 may also have an upper connection portion 190 and a lower connection portion 192. The upper connection portion 190 of the corner pillar 140 may be configured to connect to the pillar connection portion 138 of the upper corner pillar member 132, and the lower connection portion 192 may be configured to connect to the pillar connection portion 178 of the lower corner pillar member 172. In some embodiments, the upper connection portion 190 and lower connection portion 192 may have fastening apertures 194 that correspond with fastening apertures 220, 228 in an upper lap joint 214 and lower lap joint 222, respectively. In some embodiments, the corner pillars 140 may be integrally formed in either the upper deck 104A, the lower deck 104B, or both. However, in other embodiments, the corner pillars 140 may be separate elements joined to either the upper deck 104A, the lower deck 104B, or both by adhesive, heat or sonic welds, mechanical fasteners, or any other suitable means for joining elements together.

With reference to FIGS. 23-26, each of the plurality of perimeter pillars 142 includes an inner surface 196 and an outer surface 198. The pillars 142 may be generally T-shaped in cross-section and configured to connect to a corresponding upper perimeter pillar connection member 134 and lower perimeter pillar connection member 174. In some embodiments, the perimeter pillars 142 may be connected to and positioned between the upper peripheral members 115 and the lower peripheral members 155. In like manner, the one or more center pillars 144 may be generally X-shaped in cross-section and configured to connect to a corresponding upper center pillar member 136 and lower center pillar member 176. In some embodiments, the center pillars 144 may be connected to the upper deck 104A at the upper intersection 121 and may be connected to the lower deck 104B at the lower intersection 161. The inner surface 196 may further comprise pillar webbing 200 extending away from, and perpendicular to, the inner surface 196 of the perimeter pillar 142 along a longitudinal length of the pillar. As noted above the shape of the pillars 142 may be modified based on the desired rigidity of the pallet and in instances where additional rigidity is required, the shape may be more complex, such as including multiple bends or curves.

The perimeter pillars 142 may have an upper connection portion 202 and a lower connection portion 204. The upper connection portion 202 of the perimeter pillar 142 may be configured to connect to the pillar connection portion 138 of the upper perimeter pillar member 134. In some embodiments, the upper connection portion 202 of the perimeter pillar 142 may also be configured to connect to the upper webbing connection portion 118 of the upper deck 104A. Similarly, the lower connection portion 204 may be configured to connect to the pillar connection portion 178 of the lower perimeter pillar member 174. In some embodiments, the lower connection portion 204 may also be configured to connect to the lower webbing connection portion 158 of the lower deck 104B. In some embodiments, the upper connection portion 202 and lower connection portion 204 may have fastening apertures 206 that correspond with fastening apertures 220, 228 in an upper lap joint 214 and lower lap joint 222, respectively. Each of the plurality of perimeter pillars 142 may be integrally formed in either the upper deck 104A, the lower deck 104B, or both. However, in other embodiments, the perimeter pillars 142 may be separate elements joined to either the upper deck 104A, the lower deck 104B, or both by adhesive, heat or sonic welds, mechanical fasteners, or any other suitable means for joining elements together.

Figure 32:
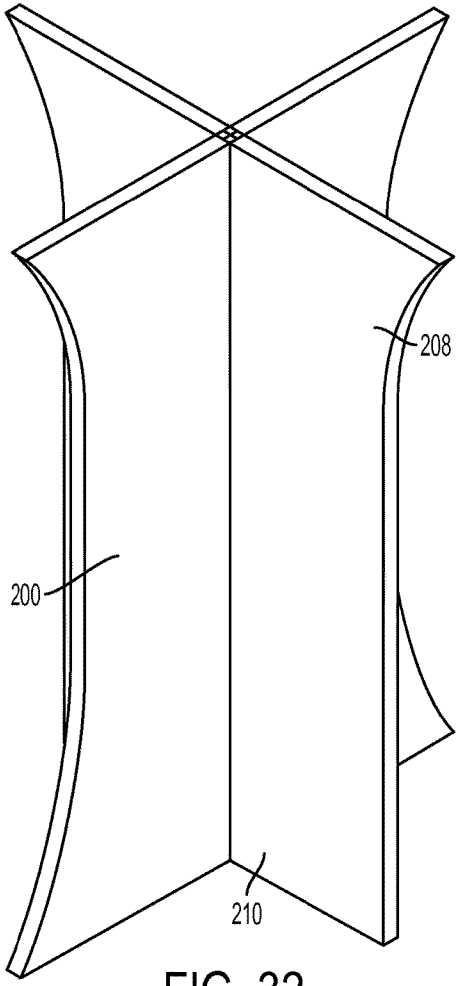
FIG. 32 is a front isometric view of a center pillar in accordance with the present disclosure.
Figure 33:
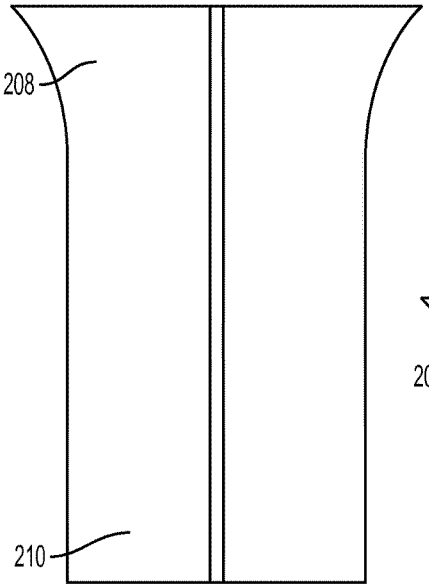
FIG. 33 is a front elevation view of the center pillar of FIG. 32.
Figure 34:
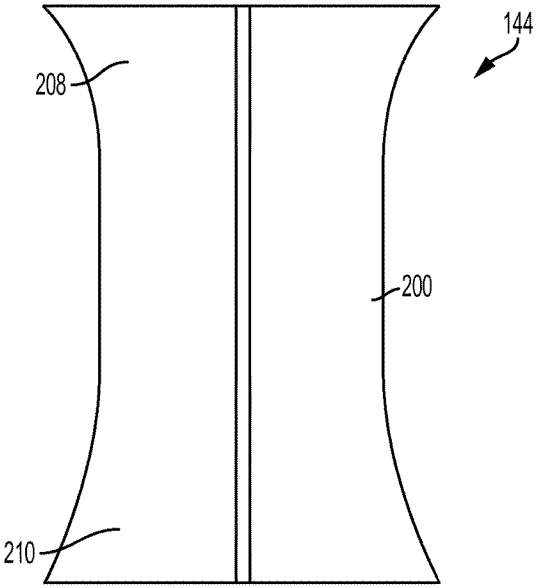
FIG. 34 is a right-side elevation view of the center pillar of FIG. 32.
Figure 35:
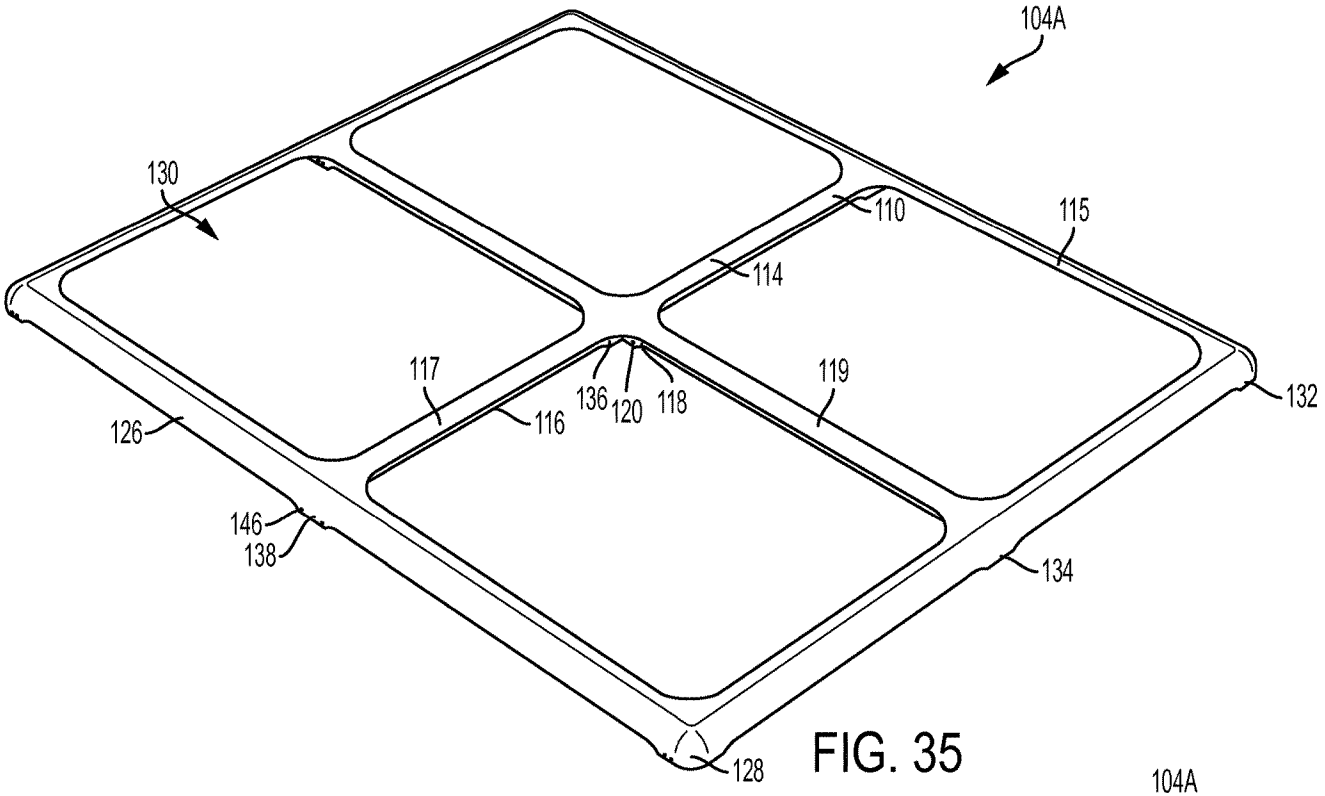
FIG. 35 is a front perspective view of the upper deck in accordance with the present disclosure.
Figure 36:
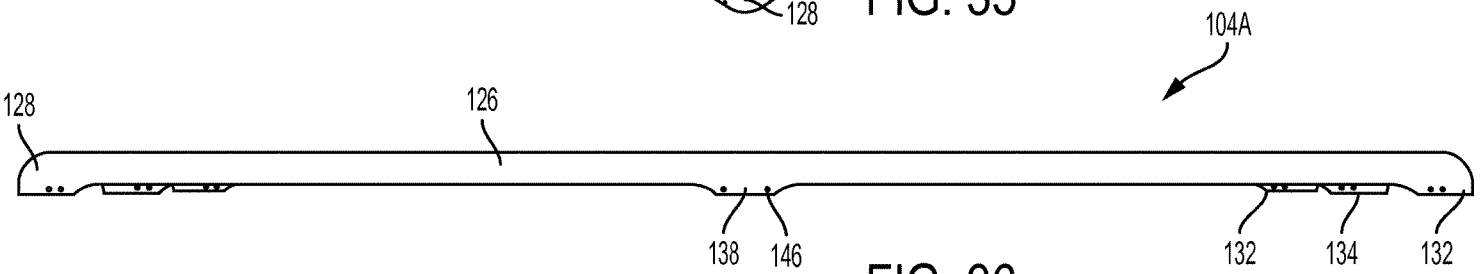
FIG. 36 is a front elevation view of the upper deck of FIG. 35.
Figure 37:
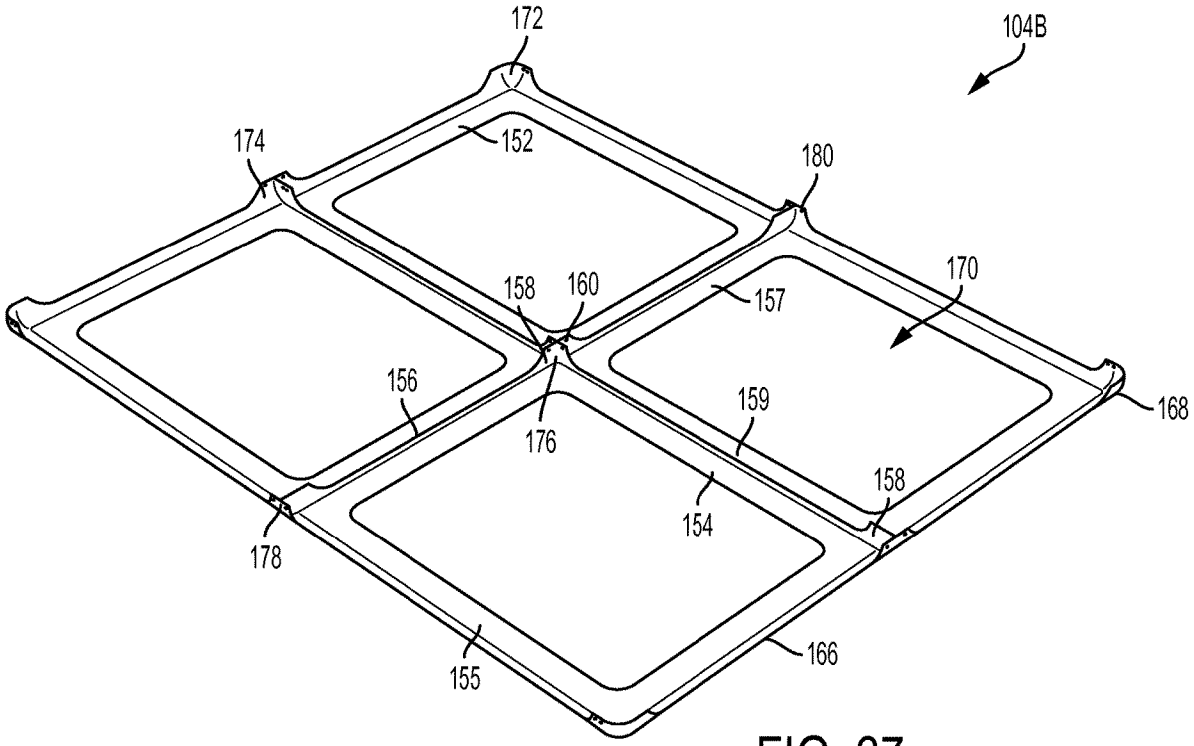
FIG. 37 is a front isometric view of the lower deck in accordance with the present disclosure.
Figure 38:
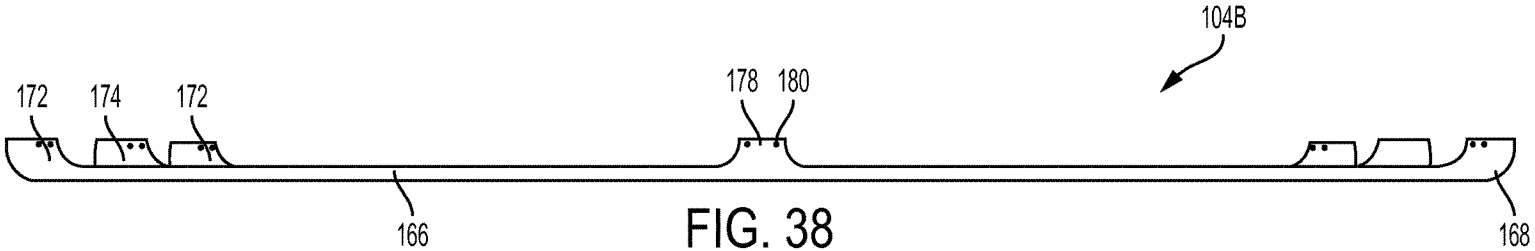
FIG. 38 is a front elevation view of the lower deck of FIG. 37

With reference to FIGS. 32-34, the center pillar 144 may be X or cross shaped and may be oriented in a center of the pallet 100. In many embodiments, the pallet 100 may include a single center pillar 144. However, in other embodiments, such as when the expected loads of the pallet 100 may be increased and/or the dimensions of the pallet 100 may be increased, the pallet may include two or more center pillars 144. The center pillar 144 may have an upper connection portion 208 and a lower connection portion 210. The upper connection portion 208 may be configured to connect to the pillar connection portion 138 of the upper center pillar member 136. In some embodiments, the upper connection portion 208 may also be configured to connect to the upper webbing connection portion 118 of the upper deck 104A. Similarly, the lower connection portion 210 may be configured to connect to the pillar connection portion 178 of the lower center pillar member 176. In some embodiments, the lower connection portion 210 may also be configured to connect to the lower webbing connection portion 158 of the lower deck 104B. In some embodiments, the upper connection portion 208 and lower connection portion 210 may have fastening apertures 212 that correspond with fastening apertures 220, 228 in an upper lap joint 214 and lower lap joint 222, respectively. Each of the one or more center pillars 144 may be integrally formed in either the upper deck 104A, the lower deck 104B, or both. However, in other embodiments, the one or more center pillars 144 may be separate elements joined to either the upper deck 104A, the lower deck 104B, or both by adhesive, heat or sonic welds, mechanical fasteners, or any other suitable means for joining elements together.

With reference to FIGS. 23-31, in some embodiments, each of the pillars 102 may further comprise an upper lap joint 214 having a protruding end segment 216 with a mating surface 218. In some embodiments, the upper lap joint 214 may be positioned on the inner surfaces 186, 196 of the pillars 102. In some embodiments, the protruding end segment 216 may have fastening apertures 220 that correspond with the fastening apertures 146, 194, 206, 212 in the pillar connection portion 138 and upper connection portions 190, 202, 208, respectively. In some embodiments, the upper lap joint 214 may be integrally formed in the pillars 102. However, in other embodiments, the upper lap joint 214 may be a separate element joined to the pillars 102 by adhesive, heat or sonic welds, mechanical fasteners, or any other suitable means for joining elements together.

The pillars 102 may be similarly configured to connect the pillars 102 to the lower pillar members 172, 174, 176. Namely, the pillars 102 may further comprise a lower lap joint 222 having a protruding end segment 224 with a mating surface 226. In some embodiments, the lower lap joint 222 may be positioned on the inner surface 186, 196 of the pillars 102 The protruding end segment 224 may have fastening apertures 228 that correspond with the fastening apertures 180, 194, 206, 212 in the pillar connection portion 178 and lower connection portions 192, 204, 210, respectively. In some embodiments, the lower lap joint 222 may be integrally formed in the pillars 102. However, in other embodiments, the lower lap joint 222 may be a separate element joined to the pillars 102 by adhesive, heat or sonic welds, mechanical fasteners, or any other suitable means for joining elements together.

In some embodiments, the pillar webbing 200 of the perimeter pillars 142 and center pillars 144 may be further configured to have an upper webbing lap joint 124 having a protruding end segment 230 with a mating surface 232. In some embodiments, the protruding end segment 230 may have fastening apertures 234 that correspond with the fastening apertures in the upper webbing connection portion 118 and upper connection portions 190, 202, 208, respectively. In some embodiments, the upper webbing lap joint 124 may be integrally formed in the pillars 102. However, in other embodiments, the upper webbing lap joint 124 may be a separate element joined to the pillars 102 by adhesive, heat or sonic welds, mechanical fasteners, or any other suitable means for joining elements together.

To connect the pillar webbing 200 of the perimeter pillars 142 and center pillars 144 to the upper webbing connection portion 118 of the upper deck 104A, the upper webbing lap joint 124 of the perimeter pillars 142 and center pillars 144 are nested into the webbing lap joint receiving portion 122 of the upper webbing connection portion 118. When connected, the mating surface 232 of the protruding end segment 230 of the upper webbing lap joint 124 will abut the webbing lap joint receiving portion 122 of the upper webbing connection portion 118. Fastening mechanisms such as fasteners, adhesive, welding, or the like may be used to connect the webbing lap joints and upper webbing connection portions together.

The perimeter pillars 142 and center pillars 144 may be similarly configured to connect the pillar webbing 200 of the perimeter pillars 142 and center pillars 144 to the lower webbing connection portion 158 of the lower deck 104B. Namely, the pillar webbing 200 of the perimeter pillars 142 and center pillars 144 may further comprise a lower webbing lap joint 164 having similar features as the upper webbing lap joint 124. The lower webbing lap joint 164 is then nested into the webbing lap joint receiving portion 162 of the lower webbing connection portion 158 of the lower deck 104B in the same manner as explained above.

With reference to FIGS. 1A-4 and 19-20, the pallet 100 may also include one or more deck panels 106. The deck panels 106 define a support surface for supporting goods and materials on the pallet 100. The deck panels 106 may be varied as desired and based on the characteristics of the goods/materials to be transported using the pallet 100. In some embodiments, there may be a plurality of upper deck panels 106A laid across the upper deck 104A. However, in other embodiments, there may be a single upper deck panel 106A that is connected to the upper deck 104A. In some embodiments, the deck panels 106 may be connected to a single side of the pallet 100, e.g., the upper deck 104A, but in other embodiments, the deck panels 106 may be connected to both sides of the pallet 100 (e.g., the upper and lower decks 104A, 104B).

The deck panels 106 may have an interior surface 240 and an exterior surface. In some embodiments, such as the embodiments shown in FIGS. 1A-4 and 19-20, the deck panels 106 may be a substantially rectangular strips including a plurality of assembly features defined thereon. As discussed above, the deck panels 106 may be configured to form a top and/or bottom surface of the pallet. In particular, although the deck panels 106 in the pallet of FIGS. 1A-4 are only illustrated as being flush with the upper exterior surface 110 of the upper deck 104A, in some embodiments, the deck panels 106 may be overlaid exterior to the exterior surfaces 110, 150 of the upper and lower decks 104A, 104B. Alternatively, the deck panels 106 may be overlaid on the interior surfaces 112, 152 of the upper and lower decks 104A, 104B.

The deck panels 106 may be a corrugated material and may include a plurality of grooves and structural ribs. The corrugated pattern on the deck panels 106 may increase the strength of the deck panels 106 and provide a drainage system to allow water, other fluids, and debris to drain off the of the pallet 100. The deck panels 106 may be substantially similar to one another, allowing the various deck panels 106 to be interchangeable. The deck panels 106 may also be formed of roll formed metals or alloys and the shapes and configurations of the deck panels 106 can be changed as desired.

With reference to FIGS. 1A-4 and 19-21, in some embodiments the deck panels 106 may have a diamond-shaped pattern that allows the pallet 100 to shed fluid and other debris. Additionally, FIGS. 1A-4 illustrate exemplary relative relationships for the pallet components that may be used. In particular, the deck panels 106 may have the same dimensions as the deck apertures 130, 170 to allow the deck panels 106 to substantially nest within the deck apertures 130, 170. However, in some embodiments, the deck panels 106 may have dimensions that are smaller than the deck apertures 130, 170 such that multiple panels 106 may be used to cover the entire span of the apertures 130, 170. It should be noted that although certain relationships are illustrated, the pallet components may be varied in length, width, thickness, height, shape, or the like depending on the desired uses of the pallet 100. Accordingly, the relationships illustrated in FIGS. 1A-4 are meant as exemplary only.

Figure 19:
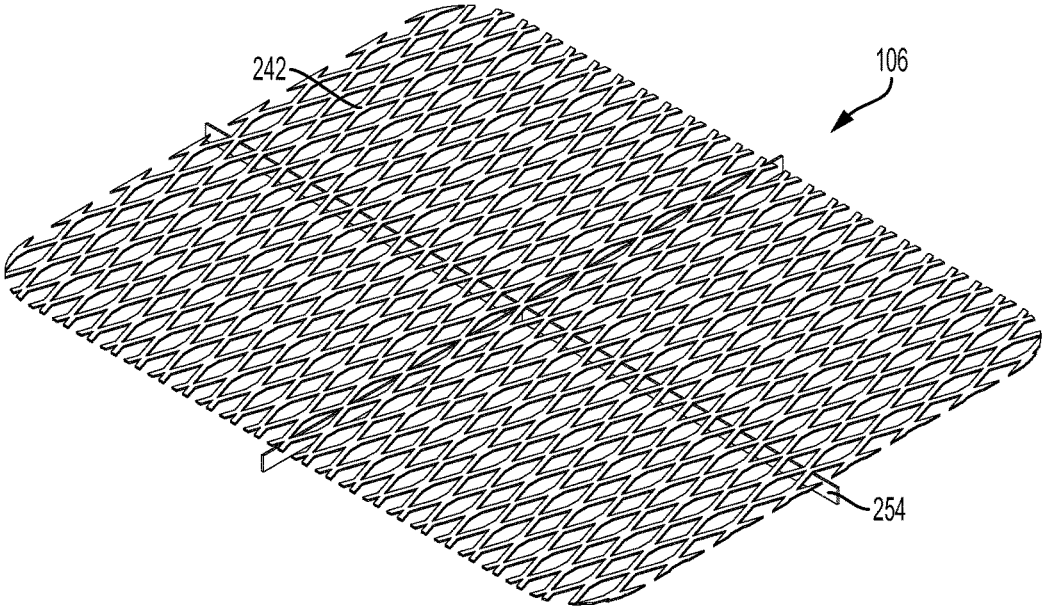
FIG. 19 is a top isometric view of a deck panel.
Figure 20:
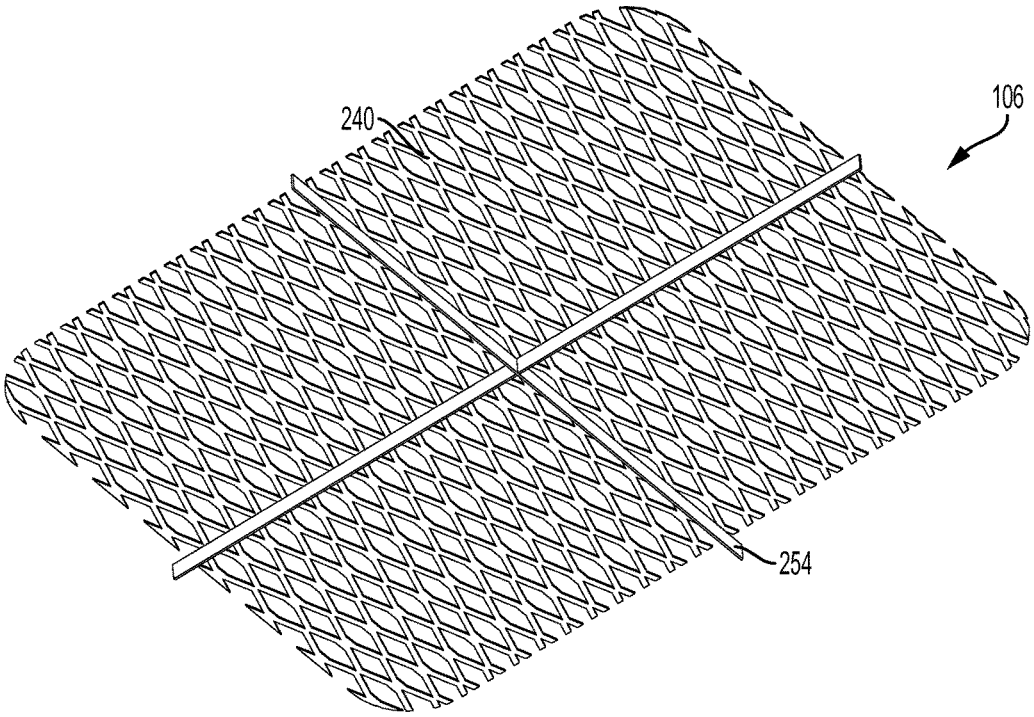
FIG. 20 is a bottom isometric view of the deck panel of FIG. 19.
Figure 21:
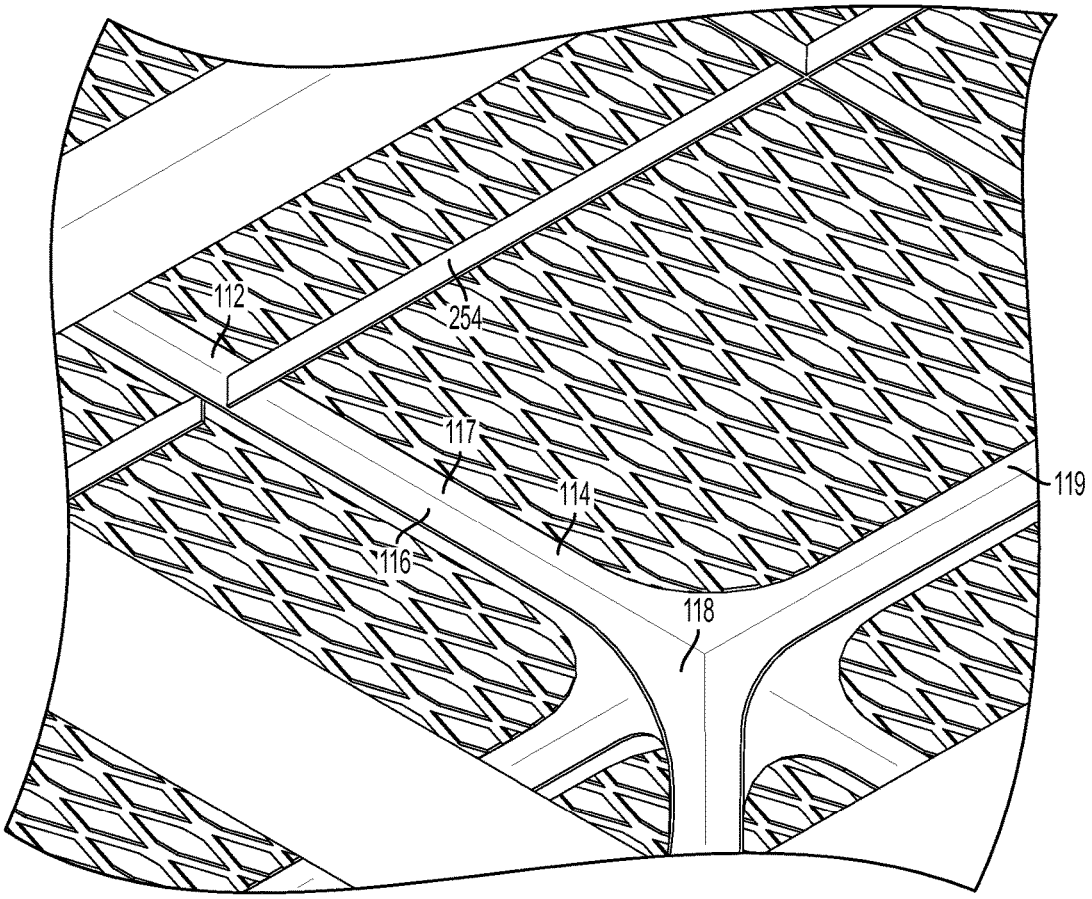
FIG. 21 is an enlarged view showing the connection of the deck panel to the pallet of FIG. 1A.

With reference to FIGS. 19-21, the deck panels 106 may also include support members 254, such as a panel frame, positioned on the interior surface 240 of the deck panels 106 and configured to support the deck panel 106 in the upper deck aperture 130. As shown in FIG. 21, the panel frame 254 may be configured to connect to the upper interior surface 112 of the upper deck 104A. In some embodiments, the panel frame 254 is integrally formed in the upper deck 104A. However, in other embodiments, the panel frame 254 may be a separate element joined to the upper deck 104A by adhesive, heat or sonic welds, mechanical fasteners, or any other suitable means for joining elements together. The panel frame 254 may also be connected to the upper webbing ridge 116, adding further strength and rigidity to the space frame web structure 238 and the pallet 100 as a whole.

That is, the frame for the pallet defines a plurality of struts that are rigidly connected together to provide resistance to force and distribute the forces relatively evenly. It is also envisioned that the panel frame 254 could be connected to the upper exterior surface 110 of the upper deck 104A or any other component of the pallet 100.

As briefly mentioned above, in some embodiments the pallet 100 may include one or more lower deck panels 106B connected to the lower deck 104B. In some embodiments, the lower deck panels 106B may be substantially the same as the deck panels 106 described above. However, in other embodiments, the lower deck panels 106B may be different from the upper deck panels 106A and may include a different finish, length, shape, or the like. In these embodiments, the lower deck panels 106B may be specifically configured to be positioned on the lower deck 104B.

Figure 22:
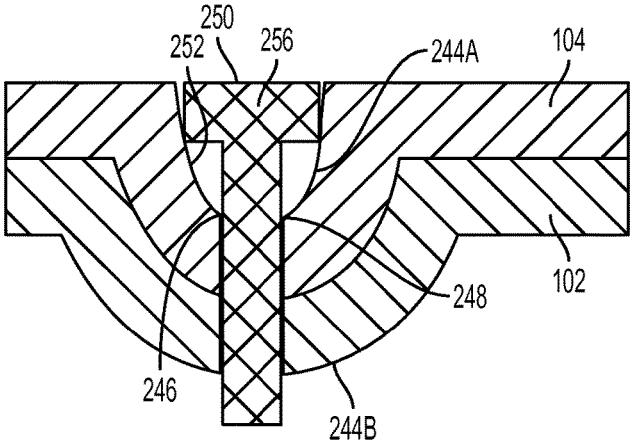
FIG. 22 is a cross-sectional view of the deck and pillar illustrating a fastener received into the dimple and fastening aperture.
Figure 24:
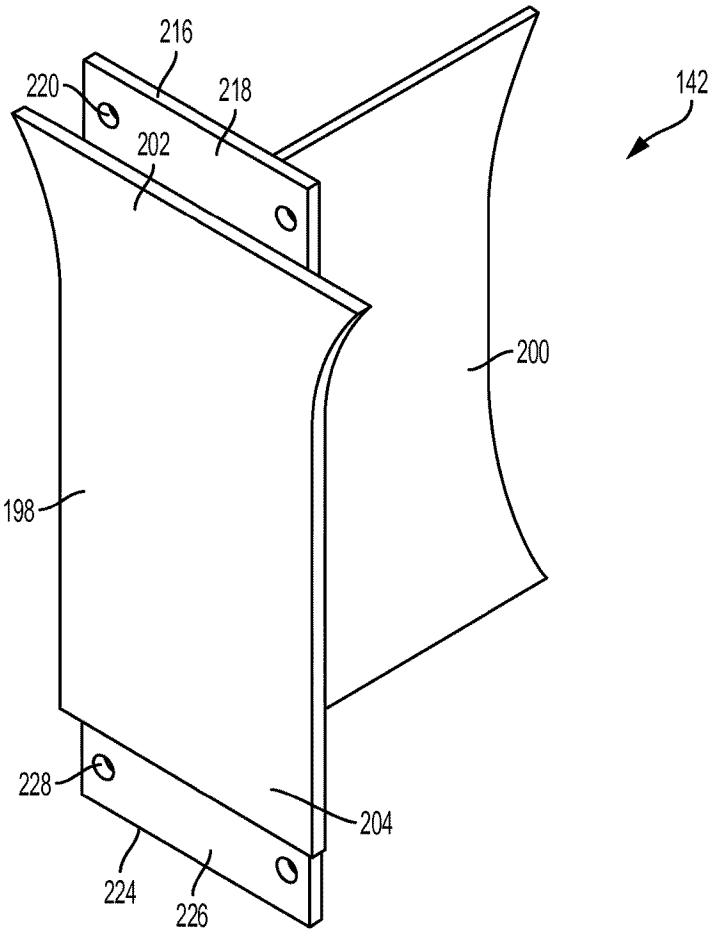
FIG. 24 is a top, rear isometric view of the perimeter pillar of FIG. 23.
Figure 23:
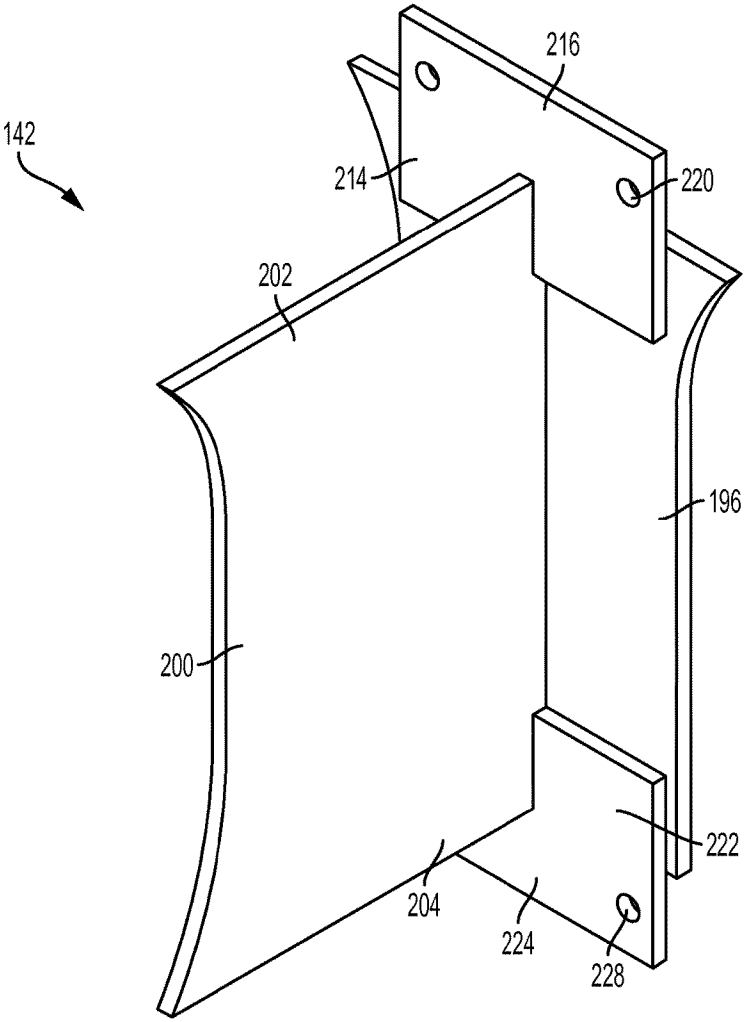
FIG. 23 is a top, front isometric view of a perimeter pillar in accordance with the present disclosure.
Figure 26:
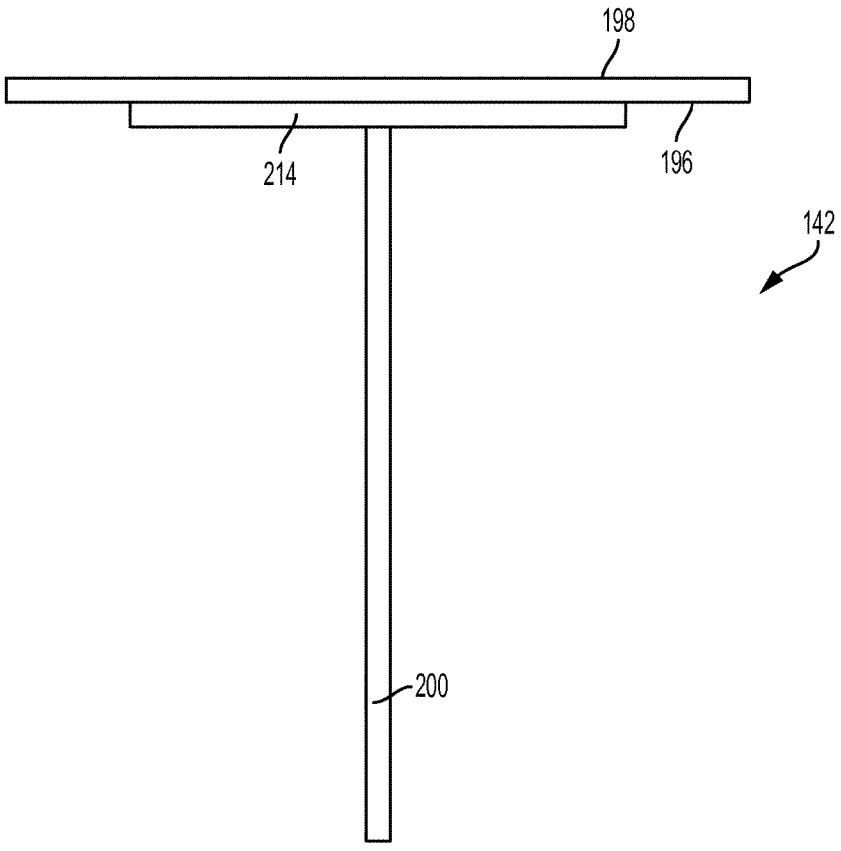
FIG. 26 is a top plan view of the perimeter pillar of FIG. 23.
Figure 25:
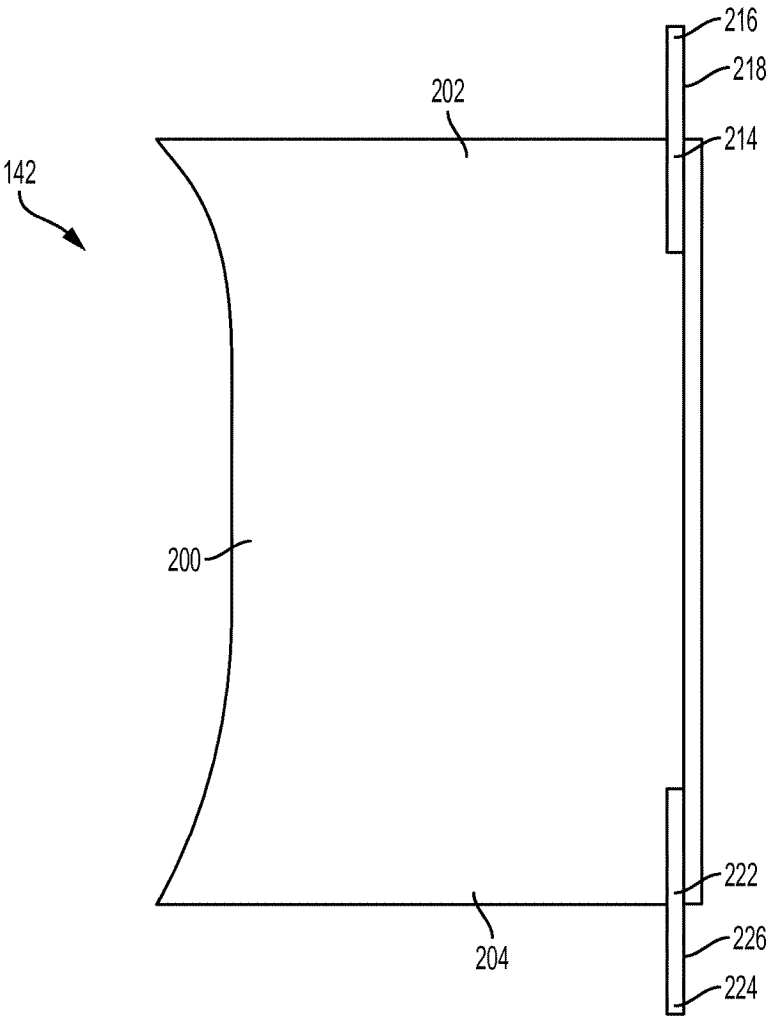
FIG. 25 is a right-side elevation view of the perimeter pillar of FIG. 23.

With reference to FIG. 22, in some embodiments, select components of the frame 236, such as the pillars 102 and decks 104, may include assembly features 244 that may in some instances be defined as depressions, such as dimples 244, formed in the outer or exterior surfaces 188, 198 of the pillars 102 and the exterior surfaces 110, 150 of the of the upper deck 104A and lower deck 104B. In the embodiment of FIG. 22, the pillars 102 are removably connected to the upper deck 104A and the lower deck 104B by at least one assembly feature 244. The dimples 244 may be concave formations and optionally include a fastening aperture 246 defined in a bottom (e.g., a bottom wall 248) of the dimple 244. In embodiments including fastening apertures 246, the apertures 246 may be configured to receive one or more fasteners 256 to secure the pillars 102 to the decks. In some instances the fastening apertures 246 are predefined in the pillars 102 and decks 104 to increase the speed at which a user can assemble the pallet 100. In other embodiments, the bottom wall 248 of the dimple 244 may have a reduced thickness as compared to other areas of the pillars 102 and decks 104, which may reduce the required force exerted by a fastener 256 to pierce through the frame material. In yet other embodiments, the thickness of the dimple walls 252 may be substantially the same as the other areas of the pillars 102 and decks 104, and the dimples 244 may not include apertures 246 defined therein. In these embodiments, the fastening apertures 246 may be defined during insertion of the fasteners 256 (e.g., punctured by the nail or rivet as it is forced through the material) or may be defined prior to assembly. For example, self-drilling fasteners may be used that drill a hole into the material if the fastening aperture 246 has not been pre-punched or otherwise pre-defined.

With continued reference to FIG. 22, in some embodiments, dimples 244A for the pillars 102 can be nested into corresponding dimples 244B in the decks 104, and the fastening apertures 246 can be aligned. This allows the fasteners 256 to be seated within the dimples 244A, 244B such that the top ends 250 of the fasteners 256 are either flush or recessed from the outer surfaces 188, 198 of either the pillars 102 or the exterior surfaces 110, 150 of the decks 104. This orientation prevents the fasteners 256 from snagging on the goods positioned on the pallet 100, from collecting debris, or the like. Further, the fasteners 256 may be selected such that the width of the head of the fastener 256 or other region extends to the walls 252 defining the dimples 244. This helps to prevent debris and the like from gathering into the dimples 244 as the fastener 256 takes up the entire dimple. The nesting arrangement provides additional strength for the connection between the pillars 102 and the decks 104, as well as provides indicator locations to alert a user as to a desired arrangement of the frame components. However, in other embodiments, the fasteners 256 and dimples 244 may be otherwise configured.

Assembly of the pallet 100 will now be discussed in more detail. Initially, the pillars 102 may be connected to and between the upper deck 104A and lower deck 104B. For example, fastening mechanisms such as fasteners, adhesive, welding, or the like may be used to connect the pillars 102 to the decks 104. However, in many embodiments, the pillars 102 and decks 104 may be connected together in a releasable manner. In these embodiments, the pillars 102 and decks 104 may be securely connected together when the pallet 100 is being used but may be disconnected to disassemble the pallet 100 for shipping, repair, or the like. When connected together, the pillars 102 may be oriented parallel to one another with the decks 104 extending perpendicular to each pillar 102 and parallel to each other.

Specifically, to connect the pillars 102 to the upper pillar members 132, 134, 136 of the upper deck 104A, the upper lap joint 214 is nested into the lap joint receiving portion 148 of the pillar connection portion 138 of the upper pillar members 132, 134, 136. When connected, the mating surface 218 of the protruding end segment 216 of the upper lap joint 214 will abut the lap joint receiving portion 148 of the upper pillar members 132, 134, 136. Fastening mechanisms such as fasteners, adhesive, welding, or the like may be used to connect the upper lap joints 214 and pillar connection portions 138 together.

To connect the pillars 102 to the lower pillar members 172, 174, 176 of the lower deck 104B, the lower lap joint 222 is nested into the lap joint receiving portion 182 of the pillar connection portion 178 of the lower pillar members 172, 174, 176. When connected, the mating surface 226 of the protruding end segment 224 of the lower lap joint 222 will abut the lap joint receiving portion 182 of the lower pillar members 172, 174, 176. Fastening mechanisms such as fasteners, adhesive, welding, or the like may be used to connect the lower lap joints and pillar connection portions together.

After the pillars 102 are connected to the upper deck 104A and lower deck 104B the combination defines the frame 236 of the pallet 100. When fully assembled, the upper beams 117, 119, lower beams 157, 159, lower webbing ridge 156, upper webbing ridge 116, perimeter pillars 142, center pillar 144, and pillar webbing 200 define an integrated space frame web structure 238. Each beam 117, 119, 157, 159 and webbing ridge 116, 156 form a T shaped cross section with the space frame web structure 238, with the upper beams 117, 119 and lower beams 157, 159 serving as the top of the T shaped structure and the webbing ridges 116, 156 serving as the web of the T shaped structure. The T shape structure continues throughout the space frame web structure via the perimeter pillars 142, the center pillars 144, and the pillar webbing 200. The space frame web structure 238, which may include a complex shape having intersecting features, provides structural support of the pallet 100 and distributes force equally throughout the web 238. Use of the space frame web structure 238 allows the pallet 100 to be made of a minimum amount of material while still providing substantial load carrying capacity. In this manner, the pallet 100 may be manufactured at relatively low cost. The pallet 100 may also weigh considerably less than those constructed with previous designs.

After the frame is assembled, the deck panels 106 may be connected to the frame. For example, the deck panels 106 may also include assembly features 244 that correspond to assembly features 244 in the decks 104A, 104B. In these embodiments, the deck panels 106 are aligned perpendicularly to the pillars 102 and parallel to the decks. The deck panels 106 may be spatially separated from one another by a spacing distance to define gaps between each deck panel. Alternatively, the deck panels 106 may abut one another to define a relatively constant top surface of the pallet. In some embodiments, the deck panels 106 may nest inside the deck apertures 130, 170 of the decks 104. In such embodiments, the exterior surface 242 of the deck panels 106 may be substantially flush with the upper exterior surface 110 of the upper deck 104A. Once aligned, a user may insert fasteners 256 into each fastening aperture 246, such as by using a rivet gun, screw gun, and/or nail gun. The fasteners 256 secure the deck panels 106 to the decks 104. In some embodiments, two to four deck panels 106 are connected to the decks 104. As shown in FIGS. 1A-4, there may be four deck panels 106, but any number of deck panels 106 is envisioned. For example, even a single deck panel 106 may be used for the pallet 100, depending on the desired size and configuration of the pallet 100.

The foregoing description has broad application. For example, while examples disclosed herein may focus on steel pallets, it should be appreciated that the concepts disclosed herein may equally apply to other types of pallets and shipping products. Accordingly, the discussion of any example is meant only to be exemplary and is not intended to suggest that the scope of the disclosure, including the claims, is limited to these examples.

Although the present invention has been described with reference to preferred examples, persons skilled in the art will recognize that changes may be made in form and detail without departing from the spirit and scope of the invention. The invention is limited only by the scope of the following claims.

What is claimed is:

1. A shipping pallet comprising:

an upper deck defining an upper exterior surface and an upper interior surface;

a lower deck defining a lower exterior surface and a lower interior surface; and a plurality of pillars connecting the upper deck to the lower deck, the plurality of pillars being spatially separated from one another; wherein:

each of the plurality of pillars includes a longitudinal web structure coupled to corresponding frame web structures of the upper and lower decks;

each longitudinal web structure extends parallel to the frame web structures to which it is coupled;

the combination of the pillars, the upper deck, and the lower deck defines a space frame structure; and the plurality of pillars are removably connected to the upper and lower decks by at least a dimple formed in an exterior surface of each pillar, the dimple arranged to engage corresponding structure of at least one of the upper and lower decks to align each pillar relative to the at least one of the upper and lower decks.

2. The shipping pallet of claim 1, wherein the upper deck comprises:

four upper peripheral members that define a perimeter of the upper deck;

a first upper longitudinal beam connected to two of the upper peripheral members; and a second upper longitudinal beam intersecting the first upper longitudinal beam at an upper intersection and connected to the other two of the upper peripheral members; and the lower deck comprises:

four lower peripheral members that define a perimeter of the lower deck;

a first lower longitudinal beam connected to two of the lower peripheral members; and a second lower longitudinal beam intersecting the first lower longitudinal beam at a lower intersection and connected to the other two of the lower peripheral members.

3. The shipping pallet of claim 2, wherein the plurality of pillars comprises:

a plurality of perimeter pillars connected to and positioned between the four upper peripheral members and the four lower peripheral members;

a plurality of corner pillars connected to and positioned between the four upper peripheral members and the four lower peripheral members and spatially separated from the perimeter pillars; and a center pillar connected to the upper deck at the upper intersection and connected to the lower deck at the lower intersection.

4. The shipping pallet of claim 3, wherein the perimeter pillars, the corner pillars, and the center pillar have different profile shapes.

5. The shipping pallet of claim 3, wherein each of the corner pillars have a rounded outer surface to define a plurality of rounded edges for the pallet.

6. The shipping pallet of claim 5 further comprising at least one lower deck panel connected to the lower deck.

7. The shipping pallet of claim 1, wherein the space frame structure defines a complex shape having intersecting features.

8. The shipping pallet of claim 1 further comprising at least one upper deck panel connected to the upper deck.

9. The shipping pallet of claim 1, wherein the plurality of pillars are arranged parallel to each other and perpendicular to the upper deck and the lower deck.

10. The shipping pallet of claim 1, further comprising a fastener aperture defined in a bottom of the dimple, wherein the fastener aperture is configured to receive a fastener.

11. The shipping pallet of claim 1, wherein the upper deck, the lower deck, and the plurality of pillars-are made of roll-formed steel.

12. A shipping pallet comprising:

an upper deck;

a lower deck; and a plurality of pillars removably connected to the upper deck and to the lower deck by at least one assembly feature, the plurality of pillars spatially separated from one another; wherein:

the at least one assembly feature comprises a dimple defined in an exterior surface of each pillar, the dimple arranged to engage corresponding structure of at least one of the upper and lower decks to align each pillar relative to the at least one of the upper and lower decks; and the combination of the pillars, the upper deck, and the lower deck defines a space frame structure.

13. A shipping pallet comprising:

an upper deck including web structures extending therefrom;

a lower deck including web structures extending therefrom; and a plurality of pillars removably connected to the upper and lower decks by one or more dimples formed in an exterior surface of each pillar, wherein the one or more dimples are arranged to engage a corresponding structure of at least one of the upper and lower decks to align each pillar relative to the at least one of the upper and lower decks; wherein:

each of the plurality of pillars includes a longitudinal web structure coupled to corresponding web structures of the upper and lower decks to define a space frame structure therewith.

* * * * *